US008734208B2

(12) United States Patent
Abe et al.

(10) Patent No.: US 8,734,208 B2
(45) Date of Patent: May 27, 2014

(54) COIN-SEPARATING APPARATUS

(71) Applicant: Asahi Seiko Kabushiki Kaisha, Tokyo (JP)

(72) Inventors: Hiroshi Abe, Saitama (JP); Masayoshi Umeda, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/971,698

(22) Filed: Aug. 20, 2013

(65) Prior Publication Data

US 2014/0057542 A1 Feb. 27, 2014

(30) Foreign Application Priority Data

Aug. 21, 2012 (JP) ..... 2012-182003

(51) Int. Cl.
*G07D 3/00* (2006.01)

(52) U.S. Cl.
USPC ..... 453/6; 453/10; 453/34; 453/49; 453/57

(58) Field of Classification Search
USPC ..... 194/228, 234, 243, 249, 294, 310, 333, 194/342, 343; 453/6, 10–13, 33–35, 49, 57
See application file for complete search history.

(56) References Cited

U.S. PATENT DOCUMENTS

| | | | | |
|---|---|---|---|---|
| 1,813,296 | A | 7/1931 | Kidwell | |
| 7,255,639 | B2 | 8/2007 | Abe et al. | |
| 2006/0019591 | A1 * | 1/2006 | Abe et al. | 453/18 |

FOREIGN PATENT DOCUMENTS

| | | |
|---|---|---|
| JP | 2006-31402 | 2/2006 |

* cited by examiner

*Primary Examiner* — Jeffrey Shapiro

(57) ABSTRACT

A coin-separating and feeding device receives coins of different dimensions, sorts them in a sorting recess positioned on a rotating disk. A moving member is positioned within a sorting recess groove and reciprocates linearly between a sorting position for receiving a coin and a pushing-out position to feed for subsequent processing. The bulk coins are stored in a container that houses the rotating disk and an arc-shaped restrictor can surround an outer periphery of at least a portion of the rotating disk to maintain the separated coin within the sorting recess. A driving device comprising a ring shaped cam is fixedly arranged relative to the rotating disk and a pair of can followers mounted on the moving member can control the speed of the mover member including accelerating and decelerating the speed from a push-out position to a coin receiving position within the sorting recess.

14 Claims, 15 Drawing Sheets

(A)

(B)

(A)

(B)

(C)

(A)

(B)

COIN-SEPARATING APPARATUS

CROSS-REFERENCE TO RELATED APPLICATION

The present application claims priority from Japanese Application 2012-182003 filed Aug. 21, 2012.

BACKGROUND OF THE INVENTION

1. Field of the Invention

The present invention relates to a coin-separating and feeding device for sorting a plurality of denominations of coins different in diameter individually to feed them to a subsequent process step.

Incidentally, the term "coin" used in this specification includes a coin which is currency, a token, a medal and the like, and the shape thereof also includes a circular shape and polygonal shape.

2. Description of Related Art

As a first prior art, in a coin processing device which is configured such that, after coins are individually sorted by holding them in sorting recesses arranged on an upper face of a rotating disk, they are delivered to a coin transporting device. A coin feeding device of the coin processing device is configured such that the sorting recesses of the rotating disk are formed in a fan shape opened on an upper face side of the rotating disk and opened on a peripheral face side of the rotating disk, each sorting recess has a coin pushing part at its portion. A mover member forming a portion of the sorting recess and movable in a diametrical direction of the rotating disk is provided in the sorting recess, and the mover member is positioned lateral to the coin pushing part at a coin receiving time, while the mover member is moved to the opened side of the peripheral face when a coin is delivered to the coin transporting device as known (for example, in U.S. Pat. No. 7,255,639).

As a second prior art, a device configured such that a selecting plate having a peripheral edge formed with a semicircular notch is disposed on an upper side of a partition wall arranged in an inclination fashion, a dispending body reciprocating elastically and linearly from the bottom portion of the notch toward an opening at a peripheral edge of the selecting plate is disposed. A a coin is sorted into its corresponding denomination by flipping the coin held at the notch at a predetermined position corresponding to a diameter of the coin in a peripheral direction by linear movement of the dispenser as known (for example, U.S. Pat. No. 1,813,296.

SUMMARY OF THE INVENTION

In the first prior art, the mover member unit is rotated about a pivoting shaft and a coin is thrown by partial pivoting of the mover member unit about the pivoting shaft to be delivered to a guide of the coin transporting device.

Therefore, after the coin is thrown, it collides against the guide. In other words, since the coin is thrown toward the guide, it may be jumped up by its reaction to a collision against the guide. The lighter a coin having a small diameter, the larger the amount of the lumping height becomes.

When a coin jumps up against the guide, a problem of erroneous detection occurs because a position of the coin relative to a sensor for detecting physical information regarding the diameter or the quality of the coin, the sensor being arranged based upon the guide, is different from a standard state. For example, there is such a problem that when a coin jumps against the guide, a diameter sensor makes erroneous discrimination such that the coin is a large diameter coin having a diameter larger than a true diameter of the coin, and when a coin to be detected is a bimetal coin, a quality sensor makes erroneous discrimination because a portion of the coin which should basically correspond to a central core portion thereof corresponds to a rim portion of the coin which is positioned at a peripheral portion of the coin.

In the second prior art, also, since a coin is basically flipped out by an elastic linear motion caused by an elastic body of the dispenser, the coin which has been flipped out collides against the guide positioned in the circumferential direction to rebound, so that there is a problem of erroneous discrimination similar to the first prior art.

Further, by combining the first prior art and the second prior art with each other, a coin can be flipped out by moving the mover member unit in the first prior art by the elastic linear motion caused by the elastic body in the second prior art, but even in this case, since the coin is flipped out of the sorting recess, it collides against the guide at the next step to rebound, such a problem as erroneous discrimination occurs like the first prior art.

In order to solve these problems, it may be though that a guide can be extended so that the diameter sensor or the quality sensor is disposed in a region where, even if a coin collides against the guide to rebound, the rebounding of the coin stops and the coin then moves while contacting with the guide. In this case, however, since the guide becomes longer, a problem occurs in that the device itself becomes large in size.

A first object of the present invention is to prevent erroneous detection due to jumping of a coin against the guide by preventing a coin from colliding against the guide when the coin is delivered from the coin-separating and feeding device to the guide of a coin discriminating device.

A second object of the present invention is to manufacture a device of the first object inexpensively.

In order to achieve the above objects, a coin-separating and feeding device according to a first aspect of the present invention is configured in the following manner.

A coin-separating and feeding device where, after coins are sorted individually by holding the coins in sorting recesses opened on an upper side and a peripheral edge side thereof on an upper face of a rotating disk arranged in an inclination state, the coins are fed out to a coin discriminating device. Each of the sorting recesses have a peripheral opening and an upper face opening formed by a sorting recess groove extending from approximately the center of the rotating disk toward an outer peripheral edge thereof. A mover member member is disposed so as to reciprocate linearly between a sorting position on a bottom portion of the sorting recess groove and a pushing-out position on a peripheral edge side of the rotating disk within the sorting recess groove. The mover member has a pushing edge facing the peripheral opening, and forms a portion of a holding recess surrounded by a left side wall and a right side wall of the sorting recess. An arc-shaped restrictor surrounds an outer periphery of the rotating disk, and the sorting recess, holding a coin, is configured, in dimensions, such that when the mover member is positioned at the sorting position, only one of the largest coins can be positioned in the holding recess and two smallest coins cannot be positioned therein in a parallel fashion, wherein, after the mover member is moved linearly toward the pushing-out position on the peripheral edge side in a predetermined phase of the rotating disk and after the mover member stays at the pushing-out position for a predetermined period of time, the mover member is driven by a driving device for moving the mover member back to the sorting position linearly. A driving device comprises a ring-like plate-shaped cam fixedly arranged adjacent the rotating disk, and a pair of cam followers are positioned inside and outside the plate-shaped cam and integrally mounted on the mover member.

With this configuration, coins can be received in the sorting recesses one by one to be sorted individually according to the rotation of the rotating disk. Specifically, since the sorting recess is a recess configured such that only one of the plurality of coins to be sorted can be held by the pushing edge of a pusher, a left side wall, and a right side wall of the recess in dimensions so that even if the coin is the smallest coin, two of them are prevented from being held within the sorting recess.

When the pusher is moved to the pushing-out position, which is a delivery position to the coin discriminating device, the mover member is positioned at the sorting position on the bottom of the sorting recess groove and is moved linearly toward the pushing-out position in a direction of the peripheral edge side of the rotating disk, namely, in a radial direction, and the mover member is moved such that the coin is pushed out of the sorting recess by the arc-shaped pushing edge of the mover member. By this movement of the mover member, the coin is securely pushed out in the peripheral direction of the rotating disk to be delivered to the coin discriminating device.

Further, the mover member is moved by the driving device composed of the ring-like plate-shape cam and the pair of cam followers positioned inside and outside of the plate-shape cam, respectively. In other words, the moving velocity of the mover member can be carefully controlled by the profile of the plate-shaped cam.

Therefore, by setting the profile of the plate-shaped cam appropriately, a coin which has been pushed out by the mover member can be prevented from jumping up at such a degree that it collides against the guide of the coin discriminating device to affect q detection of the coin. By controlling the moving velocity (acceleration) of the mover member when being moved to the pushing-out position at such a velocity that the coin does not collide against the guide, any jumping-up of the coin due to collision against the guide or the like is prevented, so that an appropriate discrimination about a coin can be made possible.

The invention according to a second aspect is directed to the coin-separating and feeding device according to a first aspect of our invention, wherein the mover member includes a pushing part having a pushing edge facing the peripheral opening and a guided portion extending from an intermediate portion of the pushing part toward the rotating disk and then further extending toward the peripheral opening. The guided portion is slidably disposed within a radial linear guide hole formed on an upper face of the rotating disk from adjacent a rotating axis of the rotating disk to extend radially to a periphery of the rotating disk.

With this configuration, the mover member has the pushing part and the guided portion formed integrally, and the guided portion is guided by the guide hole formed in the rotating disk, so that the pushing part is linearly moved in the sorting recess to push and move the coin. Therefore, by forming the guide hole in the rotating disk and integrally constituting a guided portion which is guided according to the guide hole in the mover member, the number of parts can be reduced, which results in a reduction of manufacturing cost.

The invention according to a third aspect is directed to the coin-separating and feeding device wherein the mover member is formed in such a V shape that a mover member bottom edge positioned on the opposite side of the pushing edge gradually comes close to the peripheral edge side from a central portion toward an end portion, and a bottom edge of the sorting recess groove is formed into a similar V shape to the mover member bottom edge.

With this configuration, since the bottom edge of the mover member on the opposite side is formed in the V shape, and it is formed in a similar shape to the bottom edge of the sorting recess groove, even if the bottom edge of the mover member contacts with the bottom edge of the sorting recess, the mover member is still guided to the central portion by the V shape of the bottom edge, so that a problem of a coin drawback occurring due to collision of a coin against an unpredictable portion is removed.

The invention according to a fourth aspect is directed to the coin-separating and feeding device wherein the mover member at the pushing-out position is guided by an upper outer face cam of the plate-shaped cam, while the mover member at the sorting position is guided by a lower inner face cam of the plate-shaped cam.

With this configuration, when the mover member is positioned at the pushing-out position, the mover member is guided by the upper outer face cam of the plate-shaped cam. Specifically, when the mover member is positioned on the upper side of the inclination of the rotating disk, the mover member necessarily contacts with the upper outer face cam of the plate shaped cam by gravity. Therefore, since the pushing-out position of the mover member is restricted by the outer face cam, the pushing-out position of the mover member can be restricted with high accuracy, so that a merit can be obtained in that an unpredictable problem such as collision of the mover member against another part can be avoided. Especially, the pushing and moving position of the mover member at which a coin is delivered to the coin discriminating device is important for each secure delivery of a coin.

Since restriction is performed by the outer face cam constituting the upper side of the plate-shaped cam contacting with the mover member necessarily, the position of the mover member, and therefore, the coin is necessarily restricted by the upper outer face cam of the plate-shaped cam provided in a fixed state. This position can be reproduced accurately each time, and delivery to a coin discriminating device is securely performed each time, so that discrimination of the coin can be made smoothly.

Further, the mover member is guided at the sorting position on the lower side by the lower inner face cam of the plate-like cam. Since the mover member is moved downward by gravity, the mover member contacts with the lower inner face cam of the plate-shaped cam and the position thereof is restricted by the lower inner face cam so that the mover member cannot move below the lower inner face cam. Therefore, the position of the pushing edge of the mover member is restricted by the lower inner face cam of the plate-shaped cam, and a largest diameter of a coin which can be positioned in the sorting recess can be restricted by a distance between the pushing edge and the arc-shaped restrictor arranged adjacent to the outer periphery of the rotating disk. Since the plate-shaped earn is fixed, the pushing edge is prevented from being positioned below a position corresponding to the lower inner face cam, and a proper sorting recess can be formed by arranging the position of the lower inner face cam properly, so that such coins to be sorted can be sorted individually.

Our invention according to a fifth aspect is directed to a coin-separating and feeding device, where, after coins are sorted individually by holding the coins in sorting recesses disposed on an upper face of a rotating disk arranged in an inclination state and having an tipper opening and a peripheral opening, the coins are fed to a coin discriminating device. Each of the sorting recesses have a groove-like sorting recess groove extending linearly from adjacent the center of the rotating disk toward an outer peripheral edge thereof. A mover member will reciprocate linearly between a sorting position close to a bottom of the sorting recess groove and a pushing-out position on the periphery side of the sorting recess groove.

Disposed within the sorting recess groove, the mover member has a pushing edge facing the peripheral opening and forms a holding recess surrounded by a left side wall and a right side wall of the sorting recess groove. An inner peripheral face of an arc-shaped restrictor surrounds an outer periphery of the rotating disk, and the holding recess is formed such that when the mover member is positioned at the sorting position, only one largest coin can be positioned in the holding recess but two smallest coins cannot be positioned therein in a parallel fashion, wherein the pushing edge of the mover member is formed in a recessed shape in such a manner that, when the mover member is positioned at the sorting position, the pushing edge is formed in a semi-circular shape slightly larger than the diameter of the largest coin in cooperation with the left side wall and the right side wall such that only one largest coin can be positioned in the semi-circular shape but two smallest coins cannot be positioned therein. After the mover member is moved linearly toward the pushing-out position on the peripheral edge side in a predetermined phase of the rotating disk and subsequently after the mover member stays at the pushing-out position for a predetermined period of time, the mover member is driven by a driving device for linearly moving the mover member back to the sorting position.

The driving device comprises a ring-like plate-shaped cam fixedly arranged on the rotating disk, and a pair of cam followers positioned inside and outside the plate-shaped cam, and integrally mounted on the mover member.

With this configuration, when the mover member is positioned at the pushing-out position, the mover member is guided by the upper outer face cam of the plate-shaped cam. Specifically speaking, when the mover member is positioned on the upper side of the inclination of the rotating disk, the mover member necessarily contacts with the upper outer face cam of the plate-shaped cam by gravity. Therefore, since the pushing-out position of the mover member is restricted by the outer face cam, the pushing-out position of the mover member can be restricted with high accuracy, so that such a merit can be obtained, that an unpredictable problem such as collision of the mover member against another part can be avoided. Especially, the pushing and moving position of the mover member at which a coin is delivered to the coin discriminating device is important for each secure delivery of a coin, and since restriction is performed by the outer face cam constituting the upper side of the plate-shaped earn contacting with the mover member necessarily, the position of the mover member, therefore, the coin is necessarily restricted by the upper outer face cam of the plate-shaped can provided in a fixed state, the position is reproduced accurately each time, and delivery to the coin discriminating device is securely performed each time, which results in such a merit that discrimination of the coin can be made smoothly. Further, the mover member is guided at the sorting position on the lower side by the lower inner face cam of the plate-like cam.

Since the mover member is moved downward by gravity, the mover member contacts with the lower inner face cam of the plate-shaped earn necessarily, and the position thereof is restricted by the lower inner face cam so that the mover member cannot move below the lower inner face cam. Therefore, the position of the pushing edge of the mover member is restricted by the lower inner face cam of the plate-shaped cam, and a largest diameter of a coin which can be positioned in the sorting recess can be restricted by a distance between the pushing edge and the arc-shaped restrictor arranged adjacent to the outer periphery of the rotating disk. Since the plate-shaped cam is fixed, the pushing edge is prevented from being positioned below a position corresponding to the lower inner face cam, and a proper sorting recess can be formed by arranging the position of the lower inner face cam properly, so that such a merit can be obtained that coins to be sorted can be sorted individually.

The invention according to a fifth aspect is directed to a coin-separating and feeding device, where, after coins are sorted individually by holding the coins in sorting recesses disposed on an upper face of a rotating disk arranged in an inclination state and having an upper opening and a peripheral opening, the coins are fed to a coin discriminating device, each of the sorting recess has a groove-like sorting recess groove extending linearly from the center of the rotating disk toward an outer peripheral edge thereof, a mover member reciprocating linearly between a sorting position close to a bottom of the sorting recess groove. A pushing-out position on the periphery side of the sorting recess groove is disposed within the sorting recess groove, the mover member has a pushing edge facing the peripheral opening and forms a holding recess surrounded by a left side wall and a right side wall of the sorting recess groove, and an inner peripheral face of an arc-shaped restrictor surrounding an outer periphery of the rotating disk, and the holding recess is formed such that when the mover member is positioned at the sorting position, only one largest coin can be positioned in the holding recess but two smallest coins cannot be positioned therein in a parallel fashion. The pushing edge of the mover member is formed in a recessed shape in such a manner that, when the mover member is positioned at the sorting position, the pushing edge is formed in a semi-circular shape slightly larger than the diameter of the largest coin in cooperation with the left side wall and the right side wall such that only one largest coin can be positioned in the semi-circular shape but two smallest coins cannot be positioned therein after the mover member is moved linearly toward the pushing-out position on the peripheral edge side in a predetermined phase of the rotating disk and subsequently after the mover member stays at the pushing-out position for a predetermined period of time, the mover member is driven by a driving device for moving the mover member to the sorting position linearly. The driving device comprises a ring-like plate-shaped cam fixedly arranged on the rotating disk, and a pair of cam followers positioned inside and outside the plate-shaped cam, and integrally mounted on the mover member. With this configuration, coins are stirred to be individually sorted into the sorting recesses to be held therein according to rotation of the rotating disk. Specifically, coins are stirred at a position facing a lower portion of the rotating disk by gravity, and are held in the sorting recesses one by one.

The sorting recesses are moved toward the upper portion of the inclination of the rotating disk and after arriving at the uppermost position, the sorting recesses are moved downward. In the course of movement of the mover member to the uppermost position, the cam follower contacts with the outer face cam or the inner face cam of the plate-shaped cam, and it is moved toward the peripheral opening to be sequentially moved from the sorting position to the pushing-out position according to advance to an upper portion of the inclination. At the pushing-out position, the cam follower is guided by the outer face of the plate-shaped cam. The coins sorted into the sorting recesses and held therein are sequentially pushed out of the sorting recesses according to the movements of the mover members so that their positions are defined.

The position of the coin at the pushing-out position of the mover member is a position suitable for delivery of the coin to the coin discriminating device. After the mover member is positioned at the pushing-out position, it is moved downward. The coin which has been pushed out by the mover member is delivered to the coin discriminating device. After release of the coin at the pushing-out position, the mover member is guided by the outer face cam or the inner face cam of the plate-shaped cam, and it is then returned to the lower sorting position while being guided by the lower side inner face cam.

When the cam follower is guided by the lower inner face cam, the pushing edge of the mover member is not moved below the position corresponding to the lower inner face cam. The mover member, when located at the sorting position, hardly changes, so that the size of the sorting recess does not change. Therefore, when the sorting recess is positioned at the lower portion of the rotating disk, the region of the sorting recess is maintained in a proper constant size, so that coins to be sorted can be sorted one by one securely.

Further, since the sorting recess is configured in such a manner that the pushing edge forms a recessed shape such that when the mover member is positioned at the sorting position, the pushing edge takes on a semi-circular shape slightly larger than the diameter of the largest coin in cooperation with the left side wall and the right side wall, therefore, one largest coin can be positioned in the sorting recess but two smallest coins cannot be positioned therein, which results in having coins only sorted into the sorting recesses in a one by one arrangement.

The invention according to a sixth aspect is a coin-separating and feeding device where, after coins are sorted individually by holding the coins in sorting recesses having an upper opening and a peripheral opening on a peripheral side and disposed on an upper face of a rotating disk arranged in an inclination state, the coins are fed to a coin discriminating device. Each of the sorting recesses have a sorting recess groove extending linearly from the center of the rotating disk toward an outer peripheral edge thereof. A mover member can reciprocate linearly between a sorting position close to a bottom of the sorting recess groove and a pushing-out position on a peripheral edge side of the sorting recess groove. The mover member has a pushing edge facing the peripheral opening and forms a holding recess surrounded by a left side wall and a right side wall of the sorting recess. An inner peripheral face of an arc-shaped restrictor surrounds an outer periphery of the rotating disk, and the holding recess is formed such that when the mover member is positioned at the sorting position, only one largest coin can be positioned in the holding recess but two smallest coins cannot be positioned therein in a parallel fashion. In the rotating disk, an upper opening and a peripheral opening, are formed and the sorting recess groove is formed in a groove shape to extend linearly from approximately the center of the rotating disk toward the outer peripheral edge thereof. The rotating disk is constituted by a circular and thick plate-shaped rotating flat circular plate.

A pushing disk is disposed on an inclination upper face of the rotating flat circular plate coaxially with the rotating flat circular plate and forms the sorting recess groove constituted by a left side wall and a right side wall extending from a central portion toward a peripheral direction approximately in parallel with each other, and a bottom edge connecting the left side wall and the right side wall to each other.

When the mover member is positioned at the sorting position, a holding recess at which a coin with a diameter slightly larger than the diameter of a largest coin, to be received can be held, is formed by the pushing edge of the mover member, the left side wall and the right side wall, and the arc-shaped restrictor. A driving device comprises a ring-like plate-shaped cam fixedly arranged adjacent the rotating disk, and a pair of cam followers positioned inside and outside the plate-shaped cam move integrally with the mover member.

With this configuration, coins are stirred to be sorted into the sorting recesses, one by one, according to rotation of the rotating disk. Specifically speaking, coins are stirred at a position facing a lower portion of the rotating disk by gravity, and are positioned and held in the sorting recesses one by one. The sorting recesses are moved toward the upper portion of the inclination according to the rotation of the rotating disk and after arriving at the uppermost position, the sorting recesses are moved downward. In the course of movement of the coins sorted in the sorting recesses to the uppermost position, the cam follower contacts with the outer face or the lower face of the plate-shaped cam and it is sequentially moved from the sorting position to the pushing-out position as the rotating disk advances to the upper portion of the inclination to be finally moved to the pushing-out position.

The pushing-out position is a position suitable for delivering the coin which has been pushed out by the mover member to the coin discriminating device. After the mover member stays at the pushing-out position for a short duration, it is moved downward.

When the mover member is positioned at the pushing-out position, the coin which has been pushed out by the mover member is delivered to the coin discriminating device. After the mover member stays at the pushing-out position, and subsequently after it is moved from the pushing-out position to the sorting position by the outer face cam or the inner face cam of the plate-shaped cam, the mover member is guided by the lower inner face cam and held at the sorting position for a predetermined period of time.

When the cam follower is guided by the lower inner face cam, the pushing edge of the mover member is not moved below a position corresponding to the lower inner face cam. Therefore, a position change of the mover member at the sorting position, does not substantially occur, and the size of the sorting recess does not change. Therefore, when the sorting recess is positioned at the lower portion of the rotating disk, the position of the sorting recess is maintained in a proper constant region, so that coins to be sorted can be sorted into the sorting recesses to be held therein.

Further, since the sorting recess is configured in such a manner that the pushing edge forms a recessed shape such that when the mover member is positioned at the sorting position, the pushing edge takes on a semi-circular shape slightly larger than the diameter of the largest coin in cooperation with the left side wall and the right side wall, wherein one largest coin can be held in the sorting recess but two smallest coins cannot be held therein, so that coins to be sorted can be securely sorted into the sorting recesses one by one.

A coin-separating and feeding device is provided where, after coins are sorted individually by holding the coins in sorting recesses having an upper opening and a peripheral opening on a peripheral side and disposed on an upper face of a rotating disk arranged in an inclination state, the coins are fed to a coin discriminating device. Each of the sorting recesses has a sorting recess groove extending linearly from adjacent the center of the rotating disk radially outward toward an outer peripheral edge thereof. A mover member is mounted in the sorting groove and can reciprocate linearly between a sorting position close to a bottom of the sorting recess groove and a pushing-out position on a peripheral edge side of the sorting recess groove.

The mover member has a pushing edge facing the peripheral opening and forms a holding recess between a left side wall and a right side wall of the sorting recess. An inner peripheral face of an arc-shaped restrictor surrounds an outer periphery of the rotating disk, and the holding recess is formed such that when the mover member is positioned at the sorting position, only one largest coin can be positioned in the holding recess but two smallest coins cannot be positioned therein in a parallel fashion, wherein, in the rotating disk, the upper opening and the peripheral opening on the peripheral side are formed and the sorting recess groove is formed in a groove shape to extend linearly from adjacent the center of the rotating disk toward the outer peripheral edge thereof.

The rotating disk is constituted by a circular and thick plate-shaped rotating flat circular plate. A pushing disk is disposed on an inclination upper face of the rotating flat circular plate coaxially with the rotating flat circular plate to form sorting recess grooves constituted by respective left side walls and right side walls extending from a central portion toward a peripheral direction approximately in parallel with each other. A bottom edge connects the left side wall and the right side wall to each other.

When the mover member is positioned at the sorting position, a holding recess sis formed with a diameter slightly larger than the diameter of a largest coin to be received. The coin can be held by the pushing edge of the mover member, the left side wall and the right side wall, and the arc-shaped restrictor. A driving device comprises a ring-like plate-shaped cam fixedly arranged on the rotating disk, and a pair of cam followers are positioned inside and outside the plate-shaped cam integrally with the mover member.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

A preferred embodiment is an example where a coin-separating and feeding device is used in a coin recycling machine where 8 kinds of coins composed of a 2-euro coin, a 1-euro coin, a 50-cent coin, a 20-cent coin, a 10-cent coin, a 5-cent coin, a 2-cent coin, and a 1-cent coin which are used in an Economic and Monetary Union of a European Union are received and stored for each of denominations. Coins of the predetermined denominations can be dispensed by a predetermined number based upon a payment instruction.

As used herein, the expression of a largest coin LC means a largest coin, the expression of a smallest coin SC means a smallest coin, and a simple expression of a coin C means any coin of all of 8 dimensions or a coin of some thereof.

Figure 1:
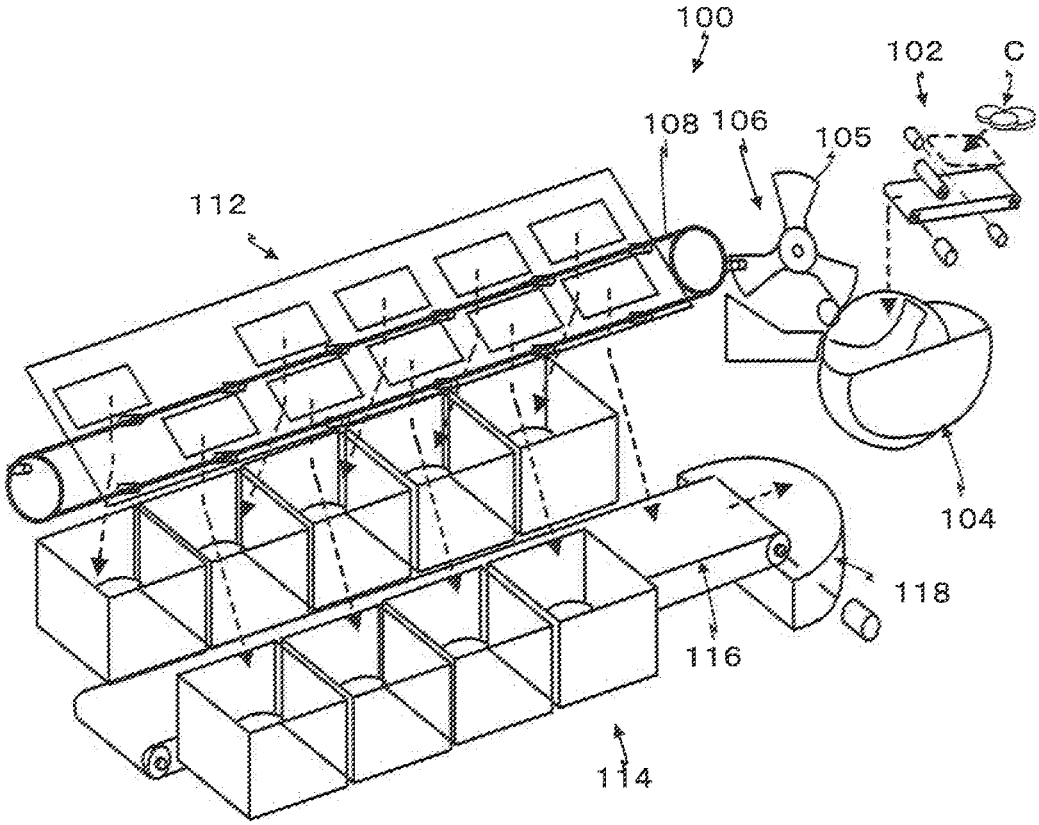
FIG. 1 is a schematic view of a coin recycling machine using a coin-separating and feeding device according to an embodiment of the present invention.

In FIG. 1, a coin recycling machine 100 includes a coin receiving device 102, a coin-separating and feeding device 104, a coin discriminating device 106, a coin transporting device 108, a coin sorting device 112 is provided along the transporting device 108, a coin storing device 114 is composed of sections corresponding to respective denominations, a payment device 116, and a receiving tray 118.

The coin receiving device 102 has a function that when a plurality of coins are collectively dropped into the coin receiving device 102, at most about two coins are simultaneously fed to the next step, and as a coin receiving device 102, various known devices, for example, the invention disclosed in Japanese Unexamined Patent Application Publication No. 2007-179189 filed by the present applicant can be adopted.

The coin-separating and feeding device 104 has a function of receiving coins received from the coin receiving device 102 in bulk to subsequently sort them one by one and feed them to a next step (coin discriminating device 106).

The coin discriminating device 106 has a function of detecting physical properties of coins and performing authenticity discrimination and denomination discrimination thereof in the course of causing the coins to be sequentially fed out of the coin-separating and feeding device 104, one by one, and to move along a linear detection guide 107 by an impeller 105. As coin discriminating device 106, various known devices, for example, the invention disclosed in Japanese Unexamined Patent Application Publication No. 2006-350563 filed by the present applicant can be adopted.

The coin transporting device 108 has a function of transporting the coins which have been discriminated regarding their authenticities and denominations by the coin discriminating device 106 to the coin sorting device 112 and as the coin transporting device 108, for example, the invention disclosed in Japanese Unexamined Patent Application Publication No, 2007-114978 filed by the present applicant can be adopted.

The coin sorting device 112 has a function of sorting true coins which have been discriminated regarding their authenticities and denominations by the coin discriminating device 106 into respective denominations in the course of transporting them by the coin transporting device 108, and as a coin sorting device 112, the invention disclosed in Japanese Unexamined Patent Application Publication No. 2007-114978 filed by the present applicant can be adopted.

The coin storing device 114 has a function of storing the coins sorted into the respective denominations and dispensing coins by a predetermined number thereof, one by one, according to a payment command, and as the coin storing device 114, a known coin hopper can be used.

The payment device 116 has a function of feeding the coins dispensed from the coin storing device 114 to the receiving tray 118, and as the payment device 116, a known flat belt device can be used. The receiving tray 118 has a function of storing coins fed out by the payment device 116 in bulk, and as the receiving tray 118, a known dished tray may be adopted.

Figure 2:
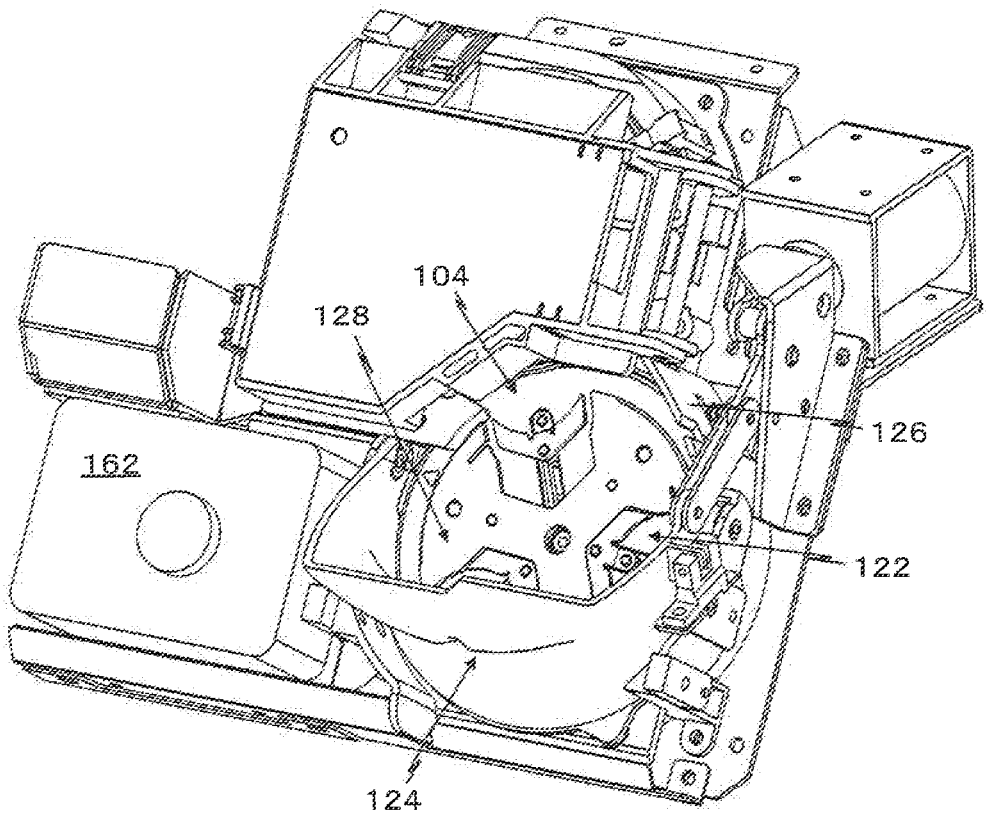
FIG. 2 is a perspective view of the coin-separating and feeding device according to the embodiment of the present invention.
Figure 3:
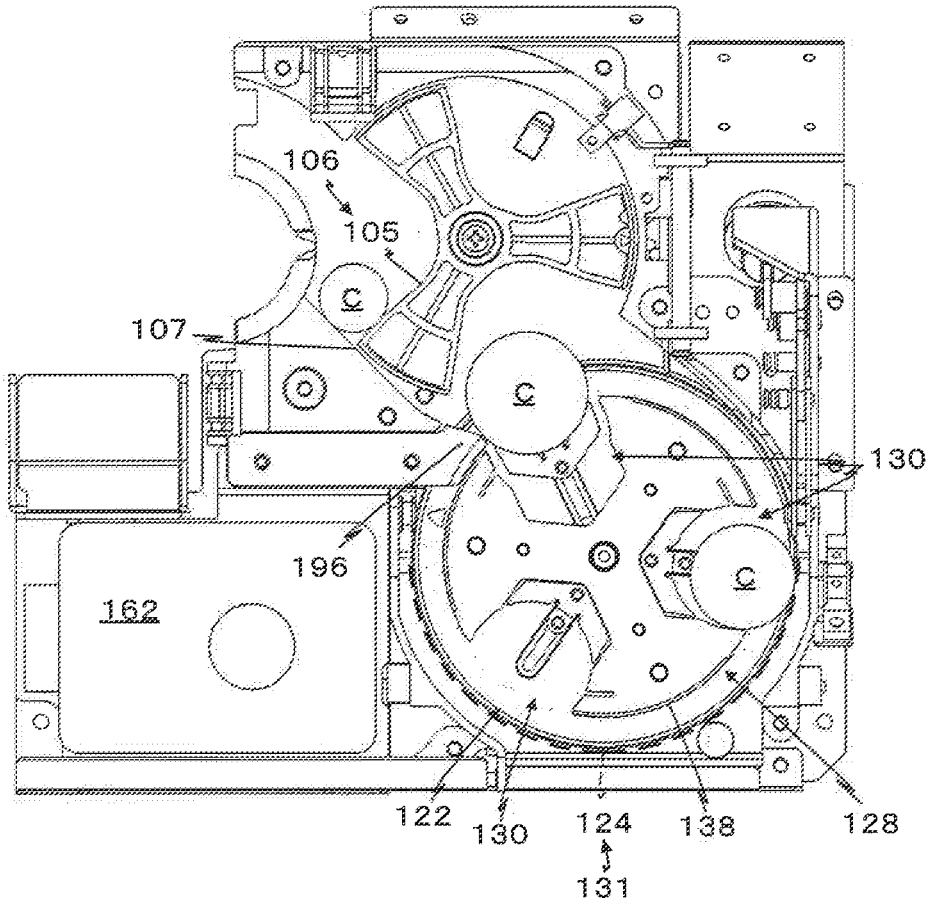
FIG. 3 is a front view the coin-separating and feeding device according to the embodiment of the present invention.

The coin-separating and feeding device 104 according to the present invention will be further described with reference to FIG. 2 and FIG. 3. The coin-separating and feeding device 104 includes a rotating disk 122, a cup-shaped storing bowl 124 for coin storage, and an arc-shaped storing guide member 126 positioned so as to enclose an upper-side portion of the rotating disk 122 corresponding to the storing bowl 124. Therefore, a periphery of a portion of the rotating disk 122 positioned below a rotation center thereof is enclosed by the storing bowl 124 (shown by a chain line in FIG. 3), and a storing chamber 128 enclosed by an upper face of the rotating disk 122 and the storing bowl 124 is formed in front of the rotating disk 122.

Incidentally, in this embodiment, since the storing bowl 124 has a function of storing coins C and a function of forming holding recesses 130 in cooperation with sorting recesses 132 described later, an arc-shaped restrictor 131 is disposed so as to enclose at least a periphery of a lower portion of the rotating disk 122 to form the holding recesses 130. The storing bowl 124 can be configured to be continuous to the arc-shaped restrictor 131 for storing coins C or can be separate components from each other. In this embodiment, an end portion of the storing bowl 124 positioned on the side of the rotating disk 122 can also serve as the arc-shaped restrictor 131.

A plurality of coins C, which have been dropped from the coin receiving device 102, is stored in the storing chamber 128 in bulk and in a piled state. Incidentally, coins dropping into the coin receiving device 102 are detected by a sensor (not shown), so that the rotating disk 122 is automatically rotated based upon such a detection. Thereby, upon dropping of the coins C into the storing chamber 128, the coins C are stirred by the rotating disk 122 to be separated one by one to be fed out to the coin discriminating device 106.

Next, the arc-shaped restrictor 131 will be described. The arc-shaped restrictor 131 has a function of enclosing at least a lower portion of the rotating disk 122, preferably, a lower half portion of the rotating disk 122, and configured to hold coins in the holding recesses 130, each holding recess holding only one coin C to be sorted, in cooperation with the sorting recess 132.

Regarding the arc-shaped restrictor 131, the storing bowl 124 constitutes the arc-shaped restrictor 131 in this embodiment, but an alternative configuration can be adopted, such that the storing bowl 124 and the arc-shaped restrictor 131 are separated from each other, and the arc-shaped restrictor 131 can be made of metal, for wear purposes, while the storing bowl 124 is made of resin, so that after the arc-shaped restrictor 131 and the storing bowl 124 are united to each other, an attachment is performed.

Next, the rotating disk 122 will be described mainly with reference to FIG. 4 to FIG. 7. The rotating disk 122 has a function of, after sorting the coins C in the storing chamber 128 one by one, feeding them in a peripheral direction to feed them to the next step, namely, the coin discriminating device 106 one by one. The rotating disk 122 has sorting recesses 132 which receive coins C one by one and it is disposed in an inclination fashion at a predetermined angle, for example, at an angle of 45° to a horizontal line, such that a lower portion of the rotating disk 122 is disposed on a bottom portion of the storing bowl 124 in an inclination fashion, and the rotating disk 122 is rotated at a predetermined velocity in a fixed direction, in a counterclockwise direction indicated by arrow D in this embodiment.

Figure 4:
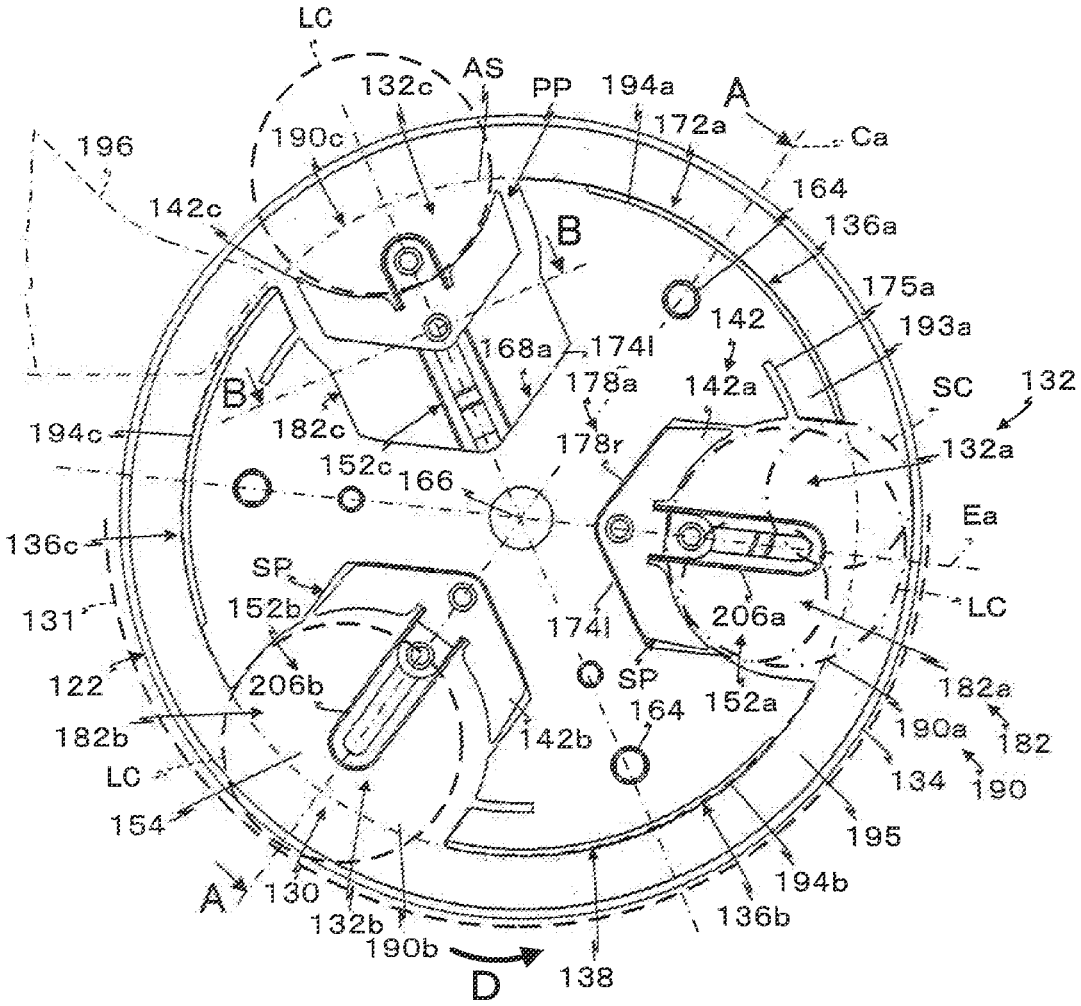
FIG. 4 is a front view of a rotating disk of the coin-separating and feeding device according to the embodiment of the present invention.
Figure 7:
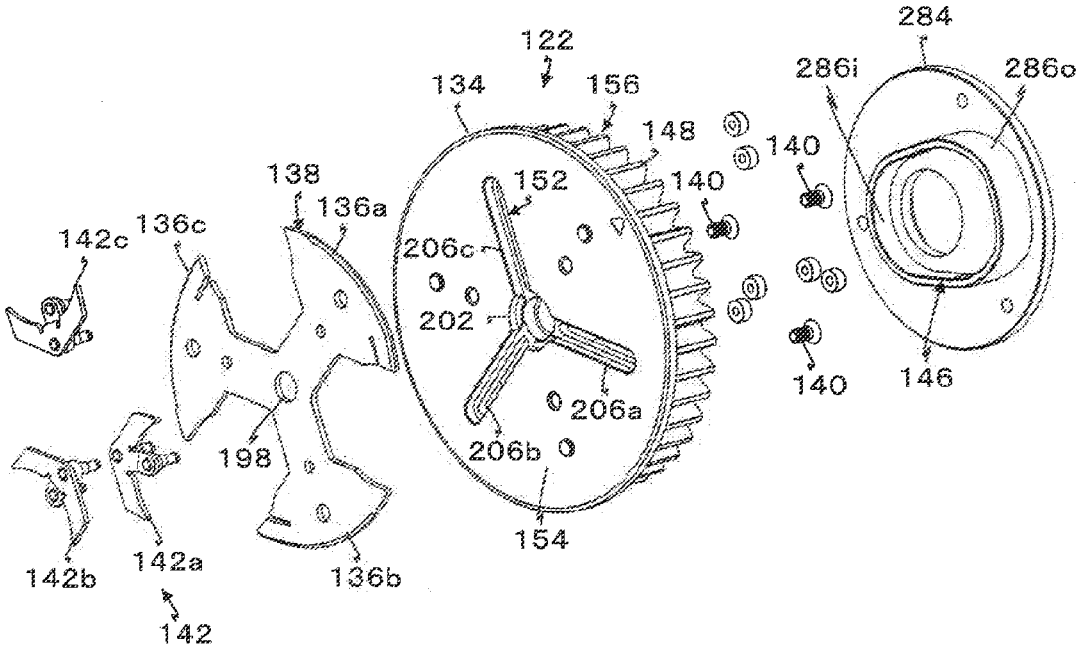
FIG. 7 is an exploded perspective view of the rotating disk of the coin-separating and feeding device according to the embodiment of the present invention.

The rotating disk 122 is composed of a rotating flat circular plate 134 having a predetermined thickness and serving as a base, a pushing disc 138 is fixed on an upper face of 154 of the rotating flat circular plate 134 coaxially with the rotating flat circular plate 134 and comprising a plate formed in a Y shape by three projection portions 136*a*, 136*b*, and 136*c* arranged at equal intervals, see FIGS. 4 and 7. Movers 142, and semi-circular sorting recesses 132*a* 132*b*, and 132*c* are formed on an upper face of the rotating flat plate 134 by spaces defined among the projection portions 136*a*, 136*b* and 136*c* of the pushing disc 138 and movers 142*a*, 142*b* and 142*c*.

Incidentally, in the specification, the term "sorting recesses 132*a*, 132*b* and 132*c*" represents individual sorting recesses, while the term "sorting recesses 132" represents all the sorting recesses 132*a*, 132*b* and 132*c*. This also holds true for other constituent elements.

First, the rotating flat circular plate 134 will be described in detail mainly with reference to FIG. 4 to FIG. 6.

The rotating flat circular plate 134 has such a function that it has the pushing disc 138 disposed on the side of an upper face thereof and a plate-shaped cam 146 is disposed on the side of a back face thereof and described later. Circular plate 134 is formed with a driven gear 148 on a peripheral face thereof, and it is formed with guide holes 152 through which the movers 142 are guided.

The rotating flat circular plate 134 has a disc-shaped member with a predetermined thickness, and it is preferably integrally formed of resin having abrasion resistance. This is because, by molding a complicated shape at one time, manufacture at a low cost is achieved while a predetermined precision is being maintained. However, the rotating fiat circular plate 134 can be made of metal in order to further improve abrasion resistance.

The upper face 154 of the rotating flat circular plate 134 is formed as a flat face, so that it can come in direct surface-contact with a face of a coin C. The term "surface-contact" used here means the case where surfaces come in close contact with each other completely but also the case that they come in rough surface-contact with each other so that the upper face 154 can exert such a function that one coin C is sorted into each of the sorting recesses 132.

A peripheral face 156 of the rotating flat circular plate 134 is formed to have a diameter slightly smaller than that of the upper face 154, the driven gear 148 for gear drive is foliated on the peripheral face 156, and the driven gear 148 meshes with a drive gear (not shown) rotated by a reducer 162(FIG. 2) driven by an electric motor (not shown) to be rotated.

Next, the pushing disc 138 will be described with reference to FIG. 3 to FIG. 6.

The pushing disc 138 provides the sorting recesses 132 in cooperation with the movers 142 and the rotating flat circular plate 134, and it has a function of moving coins C held in the sorting recesses 132 one by one in a pushing manner.

The pushing disc 138 is formed in a disc shape having a diameter roughly smaller than that of the rotating flat circular plate 134, and is formed in a Y shape by three projection portions 136*a*, 136*b* and 136*c*. The pushing disk 138 is brought in close contact with the upper face 154 of the rotating flat circular plate 134 coaxially with the rotating disk 134 and is fixed thereto by utilizing mount holes 164. Sorting recesses 132*a*, 132*b* and 132*c* are formed between the projections portions 136*a*, 136*b* and 136*c*. The reason why the pushing disc 138 is formed in a Y shape is because three sorting recesses 132 are formed.

Therefore, when two sorting recesses 132 are formed, the pushing disc 138 is formed in a H shape, and when four sorting recesses 132 are formed, the pushing disc 138 is formed in a cross shape. The number of sorting recesses 132 is determined mainly depending on a desired processing rate of coins.

Since the pushing disc 138 stirs coins, to push and move them, it is preferably produced from a metal plate, but it may be molded integrally with the rotating flat circular plate 134 from resin having abrasion resistance or alternatively according to a sintering process.

The thickness of the pushing disc 138 is formed to be slightly thinner than a thinnest coin C of coins C to be treated as true coins. This is because, even if two thinnest coins C overlap with each other, only a coin C positioned on a lower side is supported by the pushing disc 138 while a coin C riding on the former coin is not supported thereby. Since this embodiment is for euro coins, the pushing disc 138 is formed of a stainless steel plate having a plate thickness thinner than a one-cent coin, for example, 1.5 mm.

Since the projection portions 136*a*, 136*b* and 136*c* are formed to extend from a rotating axis 166 of the pushing disc 138 having a disc shape wholly in a peripheral direction at equal intervals of 120° and all of them have the same shape, the projection portion 136*a* is explained on behalf of the projection portions 136*a*, 136*h* and 136*c* and portions of the projection portions 136*b* and 136*c* identical to those of the projection portion 136*a* are attached with same reference numerals as those of the projection portion 136*a* and explanation thereof is omitted.

Figure 5:
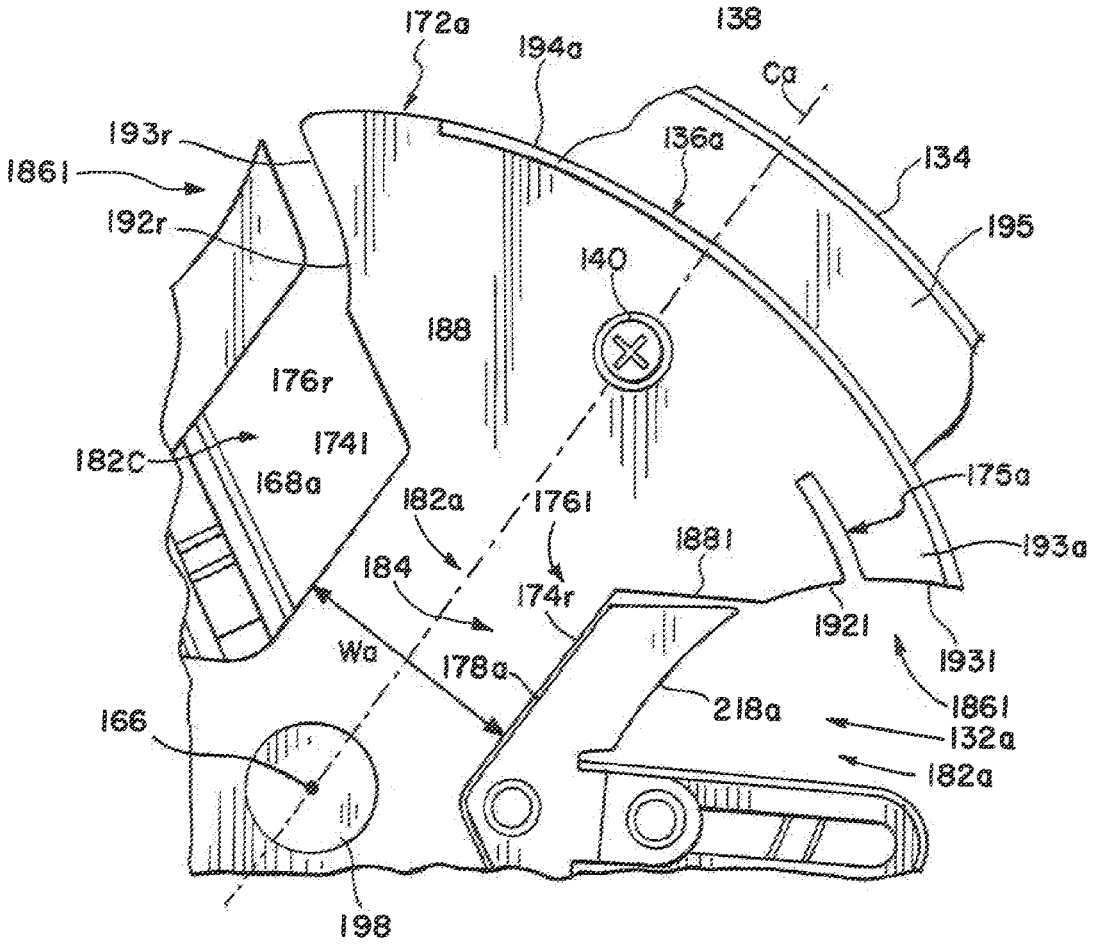
FIG. 5 is a partially enlarged view of a projection portion of the rotating disk of the coin-separating and feeding device according to the embodiment of the present invention.
Figure 6:
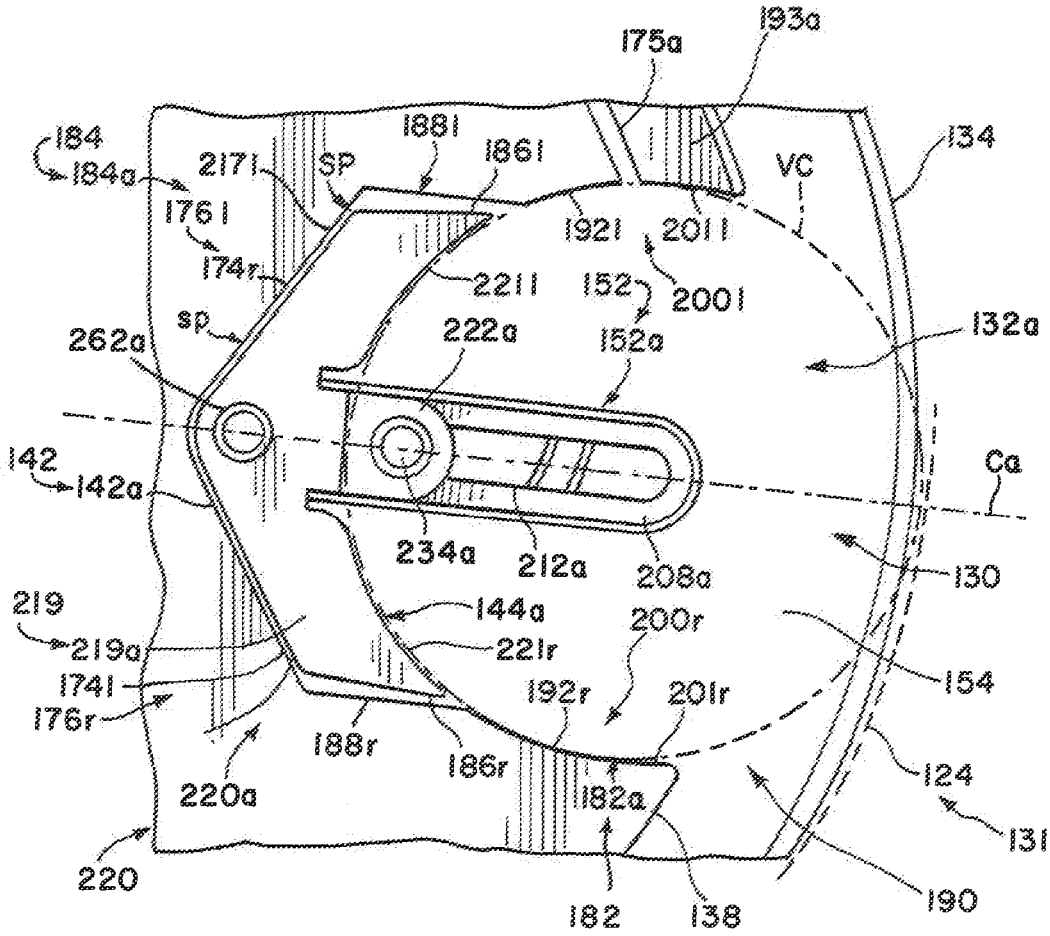
FIG. 6 is a partially enlarged view of a sorting recess of the rotating disk of the coin-separating and feeding device according to the embodiment of the present invention.

In FIG. 5, the projection portion 136*a* is formed to be approximately bilaterally symmetrical regarding a center line Ca extending through a rotating axis 166 of the pushing disc 138, and it has a proximal end portion 168*a* positioned close to the rotating axis 166 and a distal end portion 172*a* extending from a distal end of the proximal end portion 168*a*.

The proximal end portion 168*a* has a rectangular plate shape having a constant first width Wa and a left side edge 1741 thereof which constitutes a linear right bottom edge 176*r* positioned on the right side of a sorting recess groove 182*e*, to be described later, while a right side edge 174*r* constitutes a linear left bottom edge 1761 positioned on the left side of a sorting recess groove 182*a*. The right side edge 174*r* and the left side edge 1741 have the same length and they constitute a bottom edge 184*a* of the sorting recess groove 182*a* formed into a V shape for forming an angle of about 120°.

The distal end portion 172*a* is formed in a fan shape gradually expanded. Thereby, a right base wall 188*r* is continuous at an obtuse angle regarding the left side edge 1741 and a left base wall 1881 are formed to be at a predetermined angle with a center line Ca. The left base wall 1881 and the right base wall 188*r* are formed to be bilaterally symmetrical to the center line Ca.

An outer peripheral edge 194*a* of the distal end portion 172*a* is formed in an arc shape having its center at the rotating axis 166, and provides a structure where an arc-shaped outer peripheral upper face 195 having a predetermined width is exposed between the outer peripheral edge 194*a* and an outer peripheral edge of the rotating flat circular plate 134.

The outer peripheral upper face 195 enables a coin to be smoothly delivered to a knife 196, described later, by an arrangement that a distal end of the knife 196 is caused to overlap with the outer peripheral upper face 195, thus, the distal end of the knife 196 overlaps with an upper side of the outer peripheral upper face 195. A detection guide 107 is formed so as to follow the knife 196.

A circular hole 202 is formed on the rotating flat circular plate 134 about the rotation axis line thereof so as to correspond to a circular hole 198 of the pushing disc 138 about the rotating axis 166, so that the pushing disc 138 is rotatably attached to a fixing shaft (not shown) via a bearing.

A slot 175*a* is formed to extend from a boundary between a left curved wall 1921 and a left distal end side wall 2011 positioned close to the outer peripheral edge 194*a* of the distal end portion 172*a* in parallel with a tangential line of the outer peripheral edge 194*a*, and a projection for lifting up 193*a* is formed on the side of the outer peripheral edge 194*a* from the slot 175*a*, and a distal end of the lifting-up projection 193*a* is bent so as to be elevated from the upper face 154. By the lifting-up projection 193*a*, a coin C riding thereon is promoted to drop to provide a separation effect of the coin C, in other words, such an effect that sorting of the coin C is enhanced.

Next, the sorting recess groove 182*a* will be described.

The sorting recess groove 182*a* is a recess groove where the mover 142*a* is movable towards the peripheral direction of the rotating disk 122, and it forms the sorting recess 132*a* in cooperation with the mover 142*a*. The sorting recess groove 182*a* is defined by a bottom edge 184, a left side wall 2001, and a right side wall 200*r*. The left side wall 2001 is composed of the left base wall 1881, the left curved wall 1921, and the left distal end side wall 2011, while the right side wall 200*r* is composed of the right base wall 188*r*, the right curved wall 192*r*, and right distal end side wall 201*r*.

The left side wall 2001 is composed of a left curved wall 1921 that is curved at a curvature slightly larger than the diameter of the largest coin to be received. The left base wall 1881 and the left distal end side wall 2011 are formed in parallel with the left base wall 1881 following the left curved wall 1921.

The right side wall 200*r* is composed of the right curved wall 192*r* formed to have the same curvature as that of the left curved wall 1921. The right base wall 188*r* and the right distal end portion 200*r* are formed in parallel with the right base wall 188*r* following the right curved wall 192*r*. Therefore, the sorting recess groove 182*a* is formed to have a symmetrical shape regarding the center line Ca.

The left side wall 2001 is composed of the left base wall 1881, the left curved wall 1921, and the left distal end wall 2011, while the right side wall 200*r* is composed of the right base wall 188*r*, the right curved wall 192*r*, and the right distal end wall 201*r*, so that the sorting recess groove 182*a* is formed in an arrow shape in the direction toward the rotating axis 166 in appearance by the bottom edge 184, the left side wall 2001, and the right side wall 200*r*.

Since this embodiment is for euro coins, the left curved wall 1921 and the right curved wall 192*r* are set to have a curvature corresponding to 27 mm of a diameter slightly larger than 25.75 mm which is the diameter of the two-euro coin which has the largest diameter, but the curvature can be set properly if the function of the sorting recess groove 132*a* can be exerted.

The reason why the left distal end side wall 2011 and the right distal end side wall 201*r* are formed to be parallel with each other is because a coin C can be smoothly pushed out of the sorting recess 132*a*.

Next, the guide hole 152*a* for the mover 142*a* will be described.

The guide hole 152*a* has a function of guiding the mover 142*a* so as to move linearly in parallel with the axis of the sorting recess groove 182*a*, therefore the center line Ca. The guide hole 152*a* is formed as an elongated hole so as go through the rotating flat circular plate 134 vertically and extend from the rotating axis 166 radially such that a long axis thereof extends on the center line Ca. In this embodiment, as shown in FIG. 4, three movers 142 are arranged, so that three guide holes 152 are also formed.

The guide groove 152 includes mover guide longholes 206*a*, 206*b*, and 206*c* formed linearly on the center lines Ca. Since these mover guide longholes 206*a*, 206*b*, and 206*c* all have the same structure, the mover guide longhole 206*a* is explained on behalf of these longholes, and portions of the mover guide longholes 2061, and 206*c* corresponding to those of the mover guide longhole 206*a* are attached with the same reference characters and their explanation thereof is omitted.

The mover guide longhole 206*a* has a function of moving the mover 142*a* along the sorting recess groove 182*a*, more specifically, a function of linearly moving the mover 142 along the sorting recess groove 182*a* from a sorting position sp near a bottom edge 184 of the sorting recess groove 182*a* toward a pushing-out position pp and guiding the mover 142 such that the mover 142 returns from the pushing-out position pp to the sorting position sp linearly.

The mover guide longhole 206*a* is arranged such that an extending direction of the sorting recess groove 182*a* coincides with the longitudinal direction of the mover guide longhole 206*a* in an intermediate portion (center portion) of the sorting recess groove 182*a*. Such an arrangement is adopted so that a longhole center line of the mover guide longhole 206*a* overrides the center line Ca going through the top of the bottom edge 184 constituting the sorting recess groove 182*a*.

Figure 10:
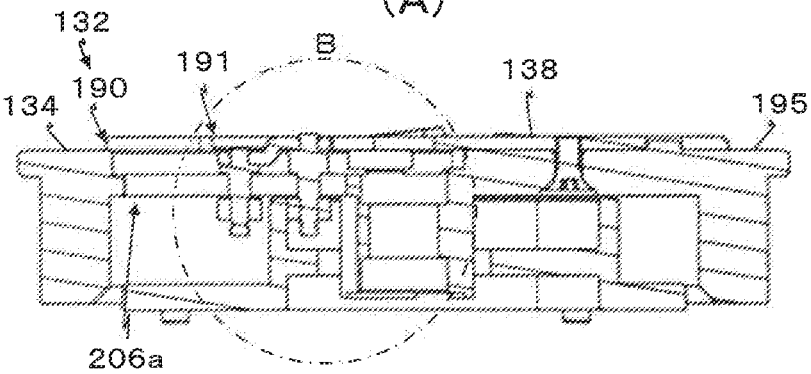
FIG. 10A is a sectional view taken along A-A in FIG. 4.
FIG. 10B is an enlarged view of B portion in FIG. 10A.
FIG. 10C is a sectional view taken along line C-C in FIG. 10B.
Figure 10:
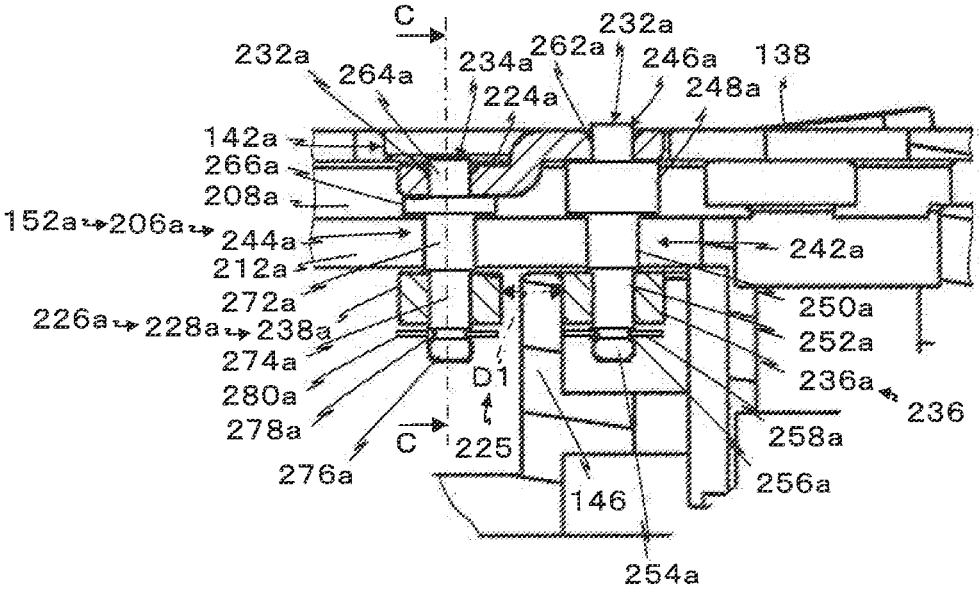
Figure 10:
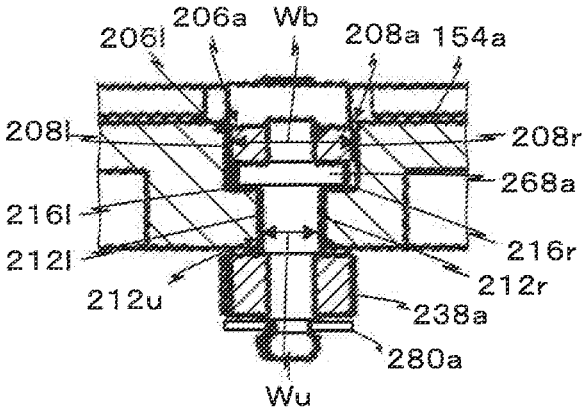

As shown in FIG. 10(C), a section orthogonal to the center line Ca of the mover guide longhole 206*a* is formed in a stepped fashion such that the width of an upper side thereof is wide while the width of a lower side thereof is narrow and it takes on a T shape extending through the rotating flat circular plate 134 vertically. Specifically, the mover guide longhole 206*a* is composed of an upper side groove 208*a* positioned near the upper face 154 and a lower side groove 212*a* positioned below the upper side groove 208*a*. The upper side groove 208*a* is formed and defined between an upper side left side wall 2081 and an upper side right side wall 208*r* formed parallel to each other, and a distance between the upper side left side wall 2081 and the upper side right side wall 208*r* is a second width Wb.

The lower side groove 212*a* is formed and defined between a lower side left side wall 2121 and a lower side right side wall 212*r* formed parallel to each other, and a distance between the lower side left side wall 2121 and the lower side right side wall 212*r* is a third width Wu. The second width Wb of the upper side groove 208*a* is larger than the third width Wu of the lower side groove 212*u*, and a left guide face 2161 and a right guide face 216*r* parallel with the upper face 154 are formed between the upper side groove 208*a* and the lower side groove 212*u*.

The pushing disc 138 is fixed to the upper face 154 of the rotating flat circular plate 134 by screws 140 penetrating the rotating flat circular plate 134 coaxially, so that the pushing disc 138 and the rotating flat circular plate 134 are integrated with each other.

Figure 8:
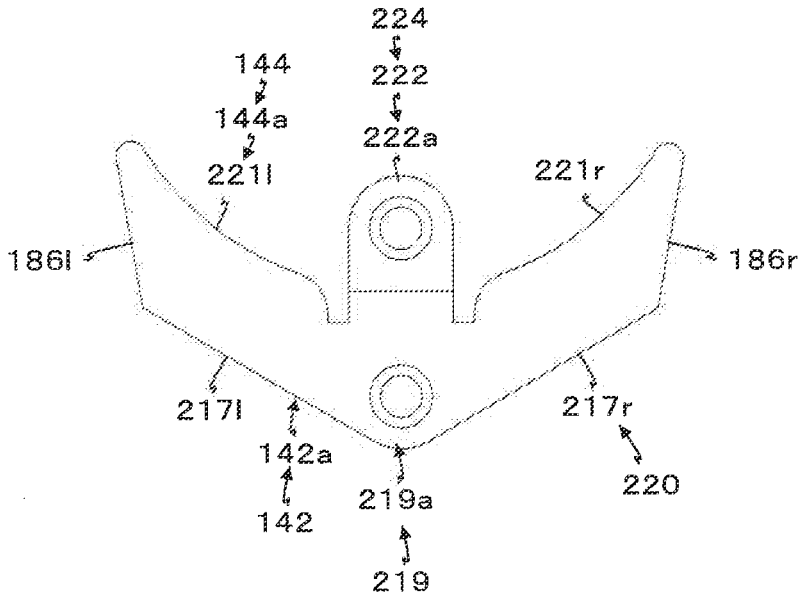
FIG. 8 is a front view of a mover of the rotating disk of the coin-separating and feeding device according to the embodiment of the present invention.
Figure 9:
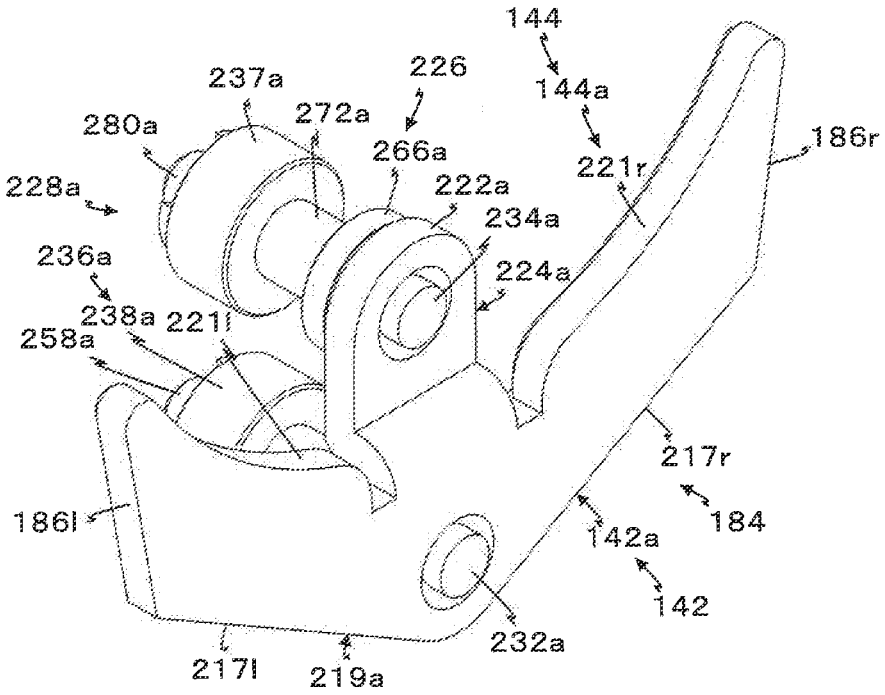
FIG. 9A and FIG. 9B show the mover of the rotating disk of the coin-separating and feeding device according to the embodiment of the present invention, FIG. 9A being a perspective view of the mover as viewed from a front thereof, and FIG. 9B being a perspective view of the mover as viewed from a back face thereof.
Figure 9:
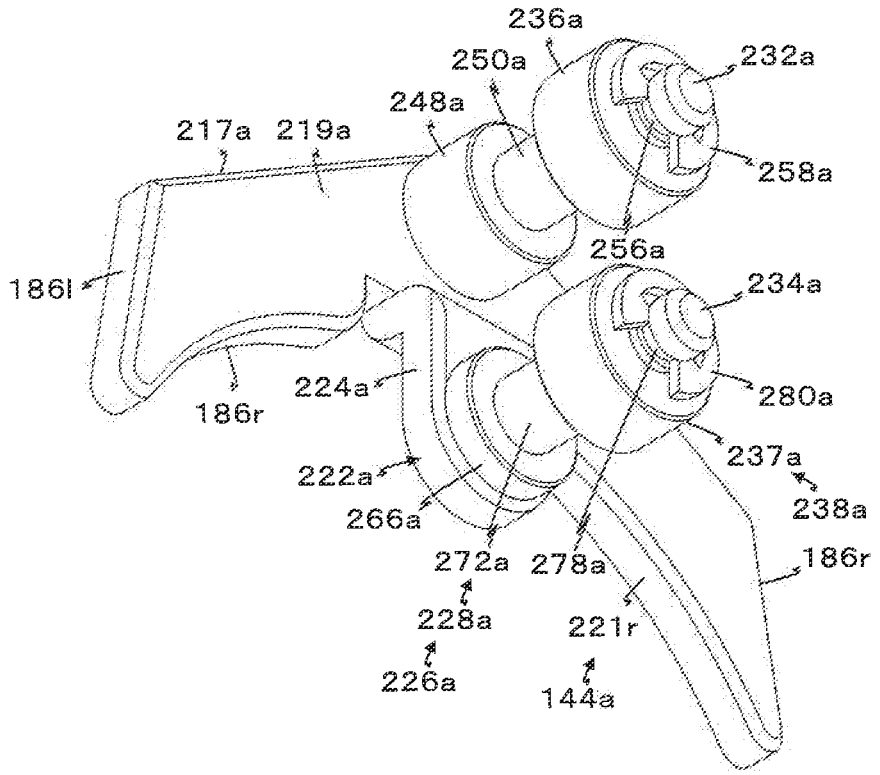

Next, the mover 142 will be described with reference to FIG. 8 to FIG. 9.

The mover 142 has a function of pushing and moving a coin C held in the sorting recess 132 in a radial movement towards the peripheral direction of the rotating disk 122, specifically, a function of, when the mover 142 is positioned at the sorting position sp, forming the sorting recess 132 in cooperation with the sorting recess groove 182 and further forming the holding recess 130 in cooperation with the arc-shaped restrictor 131 arranged near the outer periphery of the rotating disk 122.

Since the mover 142 is only required to form the holding recess 130 holding one coin C of a largest coin LC to a smallest coin SC in cooperation with the sorting recess 182 and the arc-shaped restrictor 131 and to push and move the coin C in the peripheral direction of the rotating disk 122, it may be provided with at least an arc-shaped pushing edge 144, and though the shape may have alternative shapes, the mover 142 is formed in an arc shape in plan view.

As shown in FIG. 4, since the movers 142 are disposed in the sorting recess grooves 182*a*, 182*b*, and 182*c*, respectively, they are displayed with alphabets "a", "b", and "c" corresponding to the reference characters 142, respectively. Since the movers 142*a*, 142*b*, and 142*c* are all identical, the mover 142*a* is described on behalf of the movers 142*a*, 142*b*, and 142*c*.

The mover 142*a* includes a pushing part 219*a* and a passive 222*a*. As shown in FIG. 8, the pushing part 219*a* is formed in a V shape in front view, it is disposed within the sorting recess groove 182*a*, and it has a left inner side edge 2171 and a right inner side edge 217*r* facing the bottom edge 184*a*, and the left inner side edge 2171 and the right inner side edge 217*r* are formed to be similar to the bottom edge 184*a*. The left inner side edge 2171 and the right inner side edge 217*r* are formed to be capable of coming in surface-contact with the left bottom edge 1761 and the right bottom edge 176, respectively.

The left inner side edge 2171 and the right inner side edge 217*r* constitute a V-shaped mover bottom edge 220. Further, the thickness of the pushing part 219*a* is formed to have the same thickness as that of the pushing disc 138. Like the pushing disc 138, this is because, when two thinnest coins C are stacked one on each other, an upper side coin C is not supported and is caused to drop by its own weight. However, unless the function of the pushing part 219*a* is damaged, the thickness thereof can be made thinner than the pushing disk 138.

The left side wall 1861 facing the left base wall 1881 of the pushing part 219*a* and the right side wall 186*r* facing the right base wall 188*r* are formed to have small angles to the left base wall 1881 and the right base wall 188*r*, respectively, such that a clearance between the left side wall 1861 and the right side wall 186*r* increases according to coming close to a mover bottom edge 220 (bottom edge 184). Thereby, even if the mover 142*a* is shifted due to a reaction force from a coin C so that the left side edge 1861 and the right side wall 186*r* come in frictional contact with the left base wall 1881 or the right base wall 188*r*, respectively, the mover 142*a* can move without receiving frictional resistance while a point contact is maintained.

An edge positioned on the opposite side of the left inner side edge 2171 and the right inner side edge 217*r* is formed with an arc-shaped pushing edge 144*a*. The pushing edge 144*a* is formed to have a curvature slightly larger than a diameter of the largest coin. LC to be received therein.

Next, the pushing edge 144*a* will be described.

When the mover 142 is positioned at the sorting position sp, the pushing edge 144*a* has a function of forming the sorting recess 132*a* in cooperation with the sorting recess groove 182*a* and forming the holding recess 130*a* in cooperation with the arc-shaped restrictor 131 arranged near the outer periphery of the rotating disk 122. The pushing edge 144*a* is formed in such an arc shape as to be recessed toward a peripheral opening 190.

In this embodiment, since a passive support part 222*a* is formed from an intermediate portion of the pushing edge 144*a* to extend downward, the pushing edge 144*a* is sectioned to a left pushing edge 221*l* and a right pushing edge 221*r* at the center thereof, and it is formed to be laterally symmetrical regarding the center of the center line Ca. Therefore, a coin C is pushed and moved by one or both of the left pushing edge 221*l* and the right pushing edge 221*r* according to the diameter thereof and the situation thereof.

Next, the passive support part 222*a* will be described.

The passive support part 222*a* has a function of supporting a driven device 226*a*, in other words, a function of transmitting movement of the driven device 226*a* based upon the plate-shaped cam 146 to the pushing part 219*a*.

The passive support part 222*a* is formed so as to project from an intermediate portion of the pushing edge 144*a* of the mover 142*a*. The passive support part 222*a* is formed to have a width slightly narrower than the second width Wb of the upper side groove 208*a*, so it can be inserted into the upper side groove 208*a*. A mount part 224*a* is formed by bending the passive support part 222*a* from a central portion of the pushing edge 144*a* of the mover 142*a* downward such that a length thereof is slightly longer than the thickness of the pushing part 219*a* and then bending the passive support part 222*a* in parallel with the pushing part 219*a*. In other words, the pushing part 219*a* and the mount part 224*a* are formed to have a crank shape in a side view, as shown in FIG. 10(B). The mount part 224*a* is inserted into the upper side groove 208*a* to be linearly movable along the upper side groove 208*a*.

Though the pushing part 219*a* and the passive support part 222*a* can be integrally formed by a sheet metal forming, they can also be integrally casted or molded from resin having abrasion resistance, and in this case, the pushing edge 144*a* can be formed into a continuous arc shape.

Next, a driving device 225 for the mover 142*a* will be explained.

The driving device 225 has a function of positioning the mover 142 to a predetermined position at a predetermined timing. The driving device 225 includes a driven device 226 and the plate-shaped cam 146. First, the driven device 226*a* will be described. The driven device 226*a* has a function of moving the mover 142*a* to a predetermined position at a predetermined timing according to the shape of the plate-shaped cam 146.

In this embodiment, the driven device 226*a* is a cam follower device 228*a* integrally provided on the mover 226*a*, but it is not limited to the cam follower device 228*a* and any device having the same function can be used as the driven device 226*a*.

The cam follower device 228*a* includes a first supporting part 232*a* extending from the pushing part 219*a* downward, a second supporting part 234*a* extending from a distal end portion of the passive support part 222*a* downward in parallel with the first supporting part 232*a*, and a first cam follower 236*a* and a second cam follower 237*a* attached at distal ends of the first supporting part 232*a* and the second supporting part 234*a*.

The first supporting part 232*a* and the second supporting part 234*a* are arranged such that their axes are positioned on the center line Ca, and a first intermediate portion 242*a* of the first supporting part 232*a* and a second intermediate portion 244*a* of the second supporting part 234*a* penetrate the guide hole 152*a* (the mover guide hole 206*a* (the upper side groove 208*a* and the lower side groove 212*a*)).

The first supporting part 232*a* will be described mainly with reference to FIG. 10(B). The first supporting part 232*a* is formed in a stepped round bar shape, and a first upper end part 246*a* is formed to have a diameter smaller than that of a first large-diameter part 248*a* and it is formed to have a length slightly longer than the thickness of the mover 142*a*. The first large-diameter part 248*a* is formed following the first upper end part 246*a* so as to be positioned below the first upper end part 246*a* and a length thereof is set slightly longer than the depth of the upper side groove 298*a*.

A first guided part 250*a* having a diameter slightly smaller than that of the first large-diameter part 248*a* is formed below the large-diameter part 248*a*, and it is formed to have a length equal to the depth of the lower side groove 212*a*. A first shaft part 252*a* having a diameter slightly smaller than that of the first guided part 250*a* is formed below the first guided part 250*a*, and a length thereof is set slightly longer than the thickness of a cam roller 238*a* which is the first cam follower 236*a*.

A first retainer attaching part 254*a* having a diameter equal to that of the first shaft part 252*a* is formed at a lower end portion of the first shaft part 252*a*, and a ring-like first retainer attaching groove 256*a* is formed at the first retainer attaching part 254*a*, and an inward click of a first retainer 258*a* which is a known E-type snap ring is retained at the ring-like first retainer groove 256*a* so that the first cam follower 236*a* is prevented from dropping off.

The first upper end part 246*a* is inserted into a first circular hole 262*a* formed in the mover 142*a* such that an axial center thereof is positioned on the center line Ca, and it is firmly fixed to the pushing part 219*a* by such a swaging process that a distal end of the first upper end part 246*a* is crashed by a punch.

Next, the second supporting part 234*a* will be described. The second supporting part 234*a* is formed in a stepped round bar shape, and a second upper end part 264*a* is formed to have a diameter smaller than a second large-diameter part 266*a* and it is formed to have a length slightly larger than the thickness of the mover 142*a*. The second large-diameter part 266*a* is formed following the second upper end part 264*a* on a lower side thereof, and the length thereof is set such that a length obtained by adding the thickness of the passive 222*a* and the thickness of the second large-diameter part 266*a* is equal to the depth of the upper side groove 208*a*.

A second guided part 272*a* having a diameter slightly smaller than that of the second large-diameter part 266*a* is formed below the second large-diameter part 266*a*, and it is formed to have a length equal to the depth of the lower side groove 212*a*. A second shaft part 274*a* having a diameter slightly smaller than that of the second guided part 272*a* is formed below the second guided part 272*a*, and it is formed to have a length slightly longer than the thickness of the cam roller 238*a* which is the second earn follower 237*a*. A second retainer attaching part 276*a* having a diameter equal to that of the second shaft part 274*a* is formed below the second shaft part 274*a*, a ring-like second retainer attaching groove 278*a* is formed on the second retainer attaching part 276*a*, so that an inward click of a known second retainer 280*a* is retained at the second retainer attaching part 276*a*.

When the mover 142*a* is attached to the rotating flat circular plate 134, the attaching is achieved by sequentially inserting the lower portions of the first supporting part 232*a* and the second supporting part 234*a* which are not attached with the first cam follower 236*a* and the second cam follower 237*a* into the upper side groove 208*a* and the lower side groove 212*a*, then fitting the first cam follower 236*a* and the second cam follower 237*a* on the first shaft part 252*a* and the second shaft part 274*a*, respectively, and thereafter fitting the first retainer 258*a* and the second retainer 280*a* into the first retainer attaching groove 256*a* and the second retainer attaching groove 278*a*, respectively.

Setting is performed such that the position of the mover 142*a* to the rotating flat circular plate 134 in a vertical direction is restricted by a back surface of the mover 142*a* and surfaces of the first cam follower 236*a* and the second cam follower 237*a*. Accordingly, the mover 142*a* is moved in a state where it comes in substantially-close contact with the upper face 154 of the rotating flat circular plate 134.

The position of the mover 142*a* to the rotating flat circular plate 134 in a normal direction is restricted by the first guided part 250*a* and the second guided part 272*a*, and the lower side groove 212*a* such that the mover 142*a* is not oscillated substantially from side to side. The mover 142*a* is reciprocated linearly in the longitudinal direction of the sorting recess groove 182*a* in a state where it is not substantially moved in a widthwise direction of the sorting recess groove 182*a*.

A clearance D1 is set between the circumferential faces of the first cam follower 236*a* and the second cam follower 237*a*. The plate-shaped cam 146 is disposed in the clearance D1. In other words, the plate-shaped cam 146 is sandwiched between the first cam follower 236*a* and the second cam follower 237*a*.

The mover 142*a* is linearly reciprocated between the sorting position sp and the pushing out position pp at a predetermined timing by the plate-shaped cam 146. The sorting position sp indicates a state where the mover 142*a* is positioned at a bottom portion of the sorting recess groove 182*a*, it indicates positions of the movers 142*a* and 142*b* in FIG. 4, and it indicates a position at which the mover bottom edge 220*a* has gone close to the bottom edge 184.

When the mover 142*a* is positioned at the sorting position sp, the left pushing edge 221*l*, the right pushing edge 221*r*, the left curved wall 1921, and the right curved wall 192*r* are formed to be approximately positioned on a virtual circle vv. The virtual circle vc has a diameter slightly larger than a diameter of a largest coin to be received. In this case, a peripheral edge of the virtual circle vc positioned on the opposite side of the mover 142*a* is set to come in contact with an inner edge of the storing bowl 124, therefore, the arc-shaped restrictor 131.

The pushing-out position pp indicates a position at which left and right distal ends of the pushing edge 144*a* of the mover 142*a* have come close to an outer circumferential edge of the pushing disc 138 after the mover 142*a* has been moved along the guide hole 204.

Next, the sorting recess 132*a* will be described mainly with reference to FIG. 5 and FIG. 6.

When the mover 142*a* in the sorting recess groove 182*a* is positioned at the sorting position sp, the sorting recess 132*a* is a semi-circular recessed portion defined by the pushing edge 144*a*, the left curved wall 1921, the left distal end side wall 2011, the right curved wall 192*r*, and the right distal end side wall 201*r*. Therefore, the sorting recess 132*a* is a recessed portion having a peripheral opening 190 and an upper face opening 191, and it is formed to have a depth slightly shallower than the thickness of a thinnest coin to be sorted.

The sorting recess 132*a* constitutes the holding recess 130 in cooperation with the arc-shaped restrictor 131, in this embodiment, an inner face of the storing bowl 124, and only one coin of the largest coin LC to the smallest coin SC to be sorted is held in the holding recess 130.

The expression "a coin is held" means that a surface or a back surface of a coin C is in surface-contact with the upper face 154 in the sorting recess 132*a*. In other words, two coins are not held in the sorting recess 132*a* even if they are smallest coins, and they are partially stacked one on another necessarily, so that when the partially stacked coins C are moved upward according to rotation of the rotating disk 122, a coin C of the coins C positioned on the upper side drops due to gravity. The storing bowl 124 is disposed in a range where the mover 142*a* starts to move from the sorting position sp to the pushing-out position pp. Specifically, the storing bowl 124 (arc-shaped restrictor 131) is disposed around the rotating disk 122 approximately below a horizontal line passing through the axis 166.

Next, the holding recess 130*a* will be described.

The holding recess 130*a* is a recessed portion formed on the rotating disk 122 and holding only one coin C to be sorted. As described above, the holding recess 130 is a semi-circular recess which is composed of the sorting recess 132 and the arc-shaped restrictor 131, which has the upper face opening 191 opened at an upper face thereof, whose outer periphery is substantially enclosed by the arc-shaped restrictor 131, and whose lower face is dosed.

Figure 11:
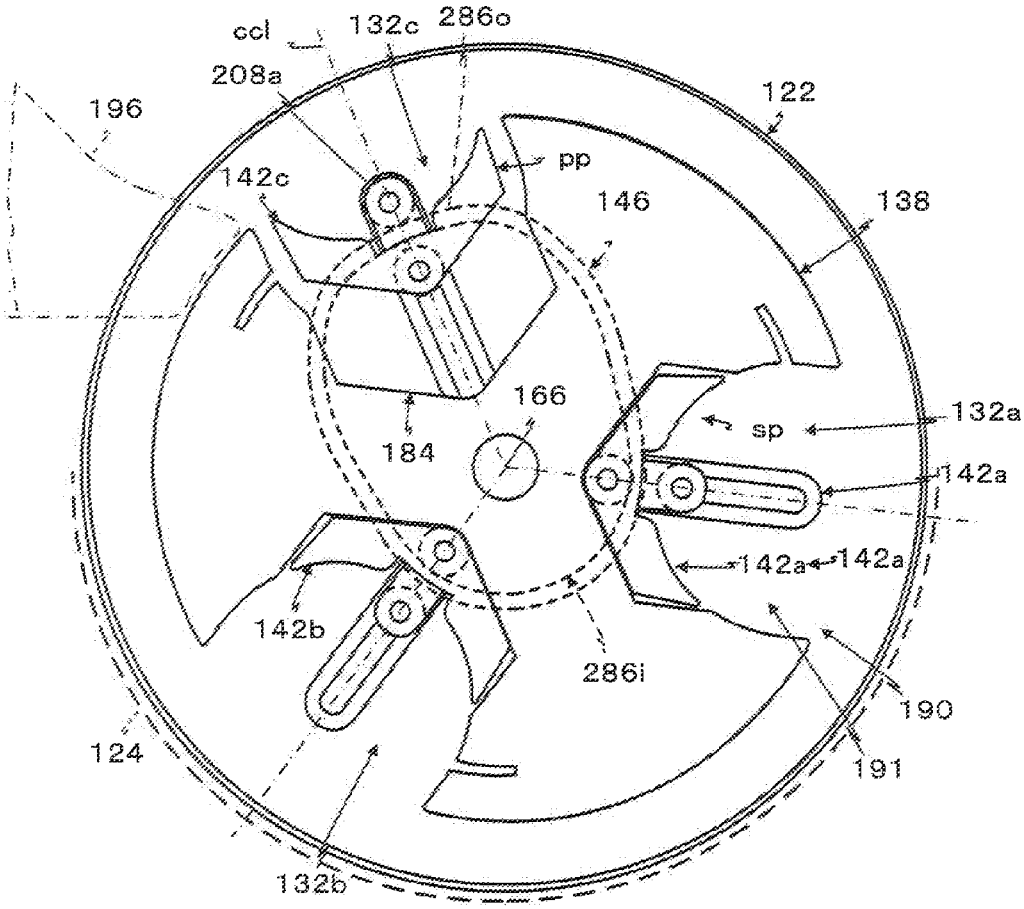
FIG. 11A and FIG. 11B show the rotating disk of the coin-separating and feeding device according to the embodiment of the present invention, FIG. 11A being a front view of the rotating disk representing a plate-shaped cam and FIG. 11B being a front view of the plate-shaped cam.
Figure 11:
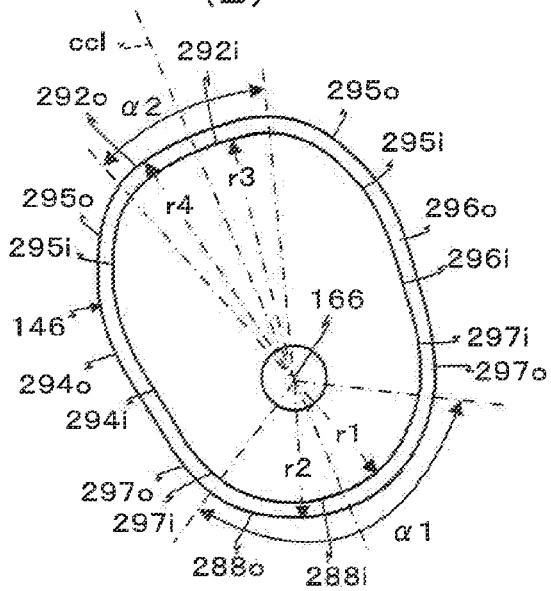

Next, the plate-shaped cam 146 will be described with reference to FIG. 7 and FIG. 11(A) and 11(B).

The plate-shaped cam 146 has a function of moving the mover 142 to a predetermined position at a predetermined timing. The plate-shaped cam 146 in this embodiment is formed in an egg-shaped ring shape and has a predetermined thickness, an end face thereof is fixed to a disc-shaped mount plate 284, and the mount plate 284 is fixed to a fixing portion (not shown) in a parallel arrangement with the rotating disk 122. In other words, the plate-shaped cam 146 is provided in a static state and the rotating disk 122 is rotated relative to the plate-shaped cam 146.

The plate-shaped cam 146 is formed to be laterally symmetrical to a cam center line ccl passing through the rotating axis 166 and inclined slightly leftward in front view. Specifically, a lower inner face cam 288*i* having a lower first radius r1 and a lower outer face cam 288*o* having a lower second radius r2 slightly larger than the lower first radius r1 are formed around the rotating axis 166 in a range of a first angle α1 which is positioned below the rotating axis 166. A difference between the lower second radius r2 and the lower first radius r1 is equal to the thickness of the plate-shaped cam 146.

The lower first radius r1 is set such that when the first cam follower 236*a* comes in contact with the lower inner face cam 288*i*, the mover 142*a* is held at the sorting position sp. In other words, when the mover 142*a* faces a lower portion of the rotating disk 122, namely, the storing chamber 128, it is held at the sorting position sp.

An upper inner face cam 292*i* having an upper first radium r3 and an upper outer face cant 292*o* having an upper second radius r4 are formed around the rotating axis 166 in a range of a second angle α2 which is positioned above the rotating axis 166.

A difference between the upper first radius r3 and the upper second radius r4 is equal to the difference between the lower second radius r2 and the lower first radius r1. In other words, the thickness of the plate-shaped cam 146 is set to be equal over a whole circumference.

The upper second radius r4 is set such that when the second cam follower 237*a* comes in contact with the upper outer face cam 292*o*, the mover 142*a* is held at the pushing-out position pp. In other words, when the mover 142*a* is positioned at an upper portion of the rotating disk 122, namely, near the knife 196, it is maintained at the pushing-out position pp.

Left side ends of the lower inner face cam 288*i* and the upper inner face cant 292*i* are connected to a linear left inner face can 294*i* connecting them gently and the upper inner face cam 292*i* and the linear left inner face cam 294*i* are connected by an arc-shape upper connecting inner face cam 295*i*, while left side ends of the lower outer face cam 288*o* and the upper outer face cam 292*o* are connected a left outer face cam 294*o* connecting them gently and the upper outer face cam 292*o* and the left outer face cam 294*o* are connected by an arc-shaped upper connecting outer face cam 295*o*.

Right side ends of the lower inner face cam 288*i* and the upper inner face cam 292*i* are connected to a linear right inner face cam 296*i* connecting them gently, and the lower inner face cam 288*i* and the right inner face cam 296*i* are connected by an arc-shaped lower connecting inner face cam 297*i*, while right side ends of the lower outer face cam 288*o* and the upper outer face cam 292*o* are connected to a linear right outer face cam 296*o* connecting them gently, and the lower outer face cam 288*o* and the right outer face cam 296*o* are connected by an arc-shaped lower connecting outer face cam 287*o*.

The plate-shaped cam 146 is disposed to be positioned in a clearance D1 between the first can follower 236*a* and the second Cain follower 237*a*. In this embodiment, the first cam follower 236*a* and the second cam follower 237*a* are set to be guided at predetermined periods by the outer face cam 286*o* and the inner face cam 286*i* of the plate-shaped cam 146.

Thereby, when the first cam follower 236*a* or the second cam follower 237*a* is selectively guided by the right inner face cam 296*i* and the right outer face cam 296*o*, the upper connecting inner face cam 295*i* and the upper connecting outer face cam 295*o*, and the lower connecting inner face cam 297*i* and the lower connecting outer face cam 297*o*, respectively, the movers 142*a* to 142*c* are sequentially moved from the sorting position sp to the pushing-out position pp.

When the first cam follower 236*a* or the second cam follower 237*a* is selectively guided by the left inner face cam 294*i* or the left outer face cam 294*o*, the upper connecting inner face cam 295*i* and the upper connecting outer face cam 295*o*, and the lower connecting inner face cam 297*i* and the lower connecting outer face cam 297*o*, respectively, the movers 142*a* to 142*c* are sequentially moved from the pushing-out position pp to the sorting position sp.

Therefore, since the first cam follower 236*a* and the second cam follower 237*a* can be positioned on a line inclined relative to the plate-shaped cam 146, the clearance D1 is set larger than the thickness of the plate-shaped cam 146 such that smooth guiding can still be performed.

Figure 12:
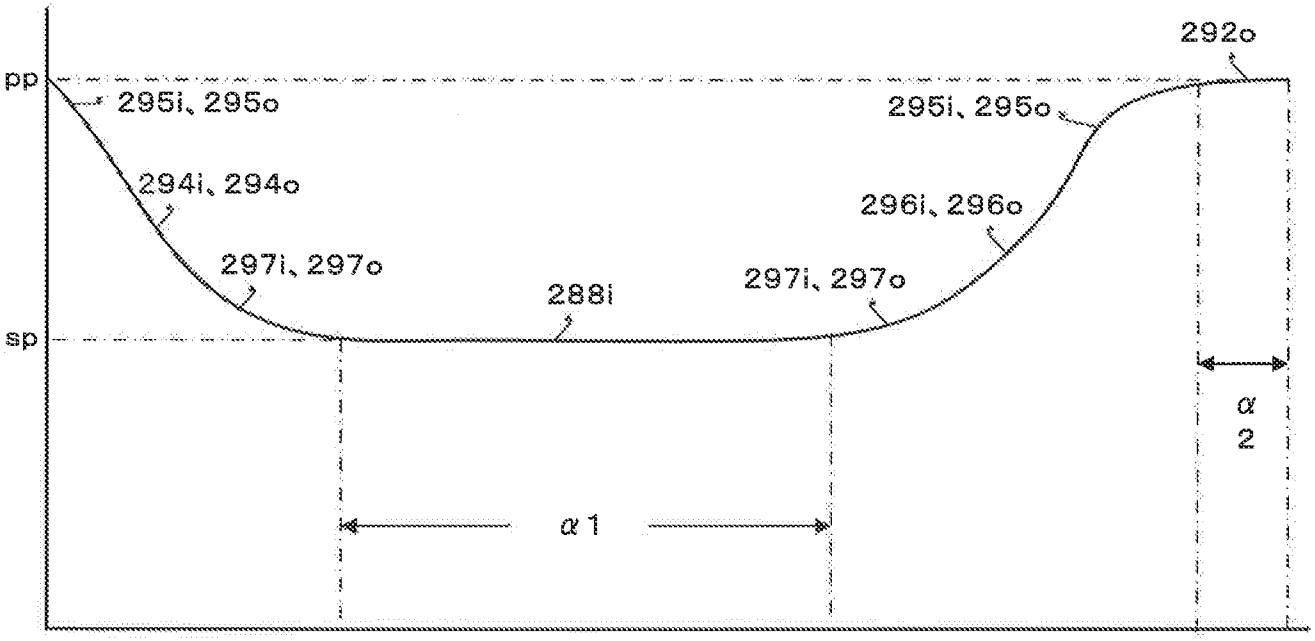
FIG. 12 is a cam follower of the plate-shaped cam of the coin-separating and feeding device according to the embodiment of the present invention.

The profile of the plate-shape cam 146 is shown in FIG. 12. A cam profile, when the rotating disk 122 is rotated in a counterclockwise direction from a starting point, which is the boundary between the upper inner face cam 292*o* and the upper connecting inner face cam 295*i* or the upper outer face cam 295*i* and the upper connecting outer face cam 295*o* will be described.

First, the first cam follower 236*a* or the second cam follower 237*a* is guided at a relatively slow speed by the upper connecting inner face cam 295*i* or the upper connecting outer face cam 295*o*, so that the mover 142*a* is moved from the pushing-out position pp toward the sorting position sp.

Subsequently, since the first cam follower 236*a* or the second cam follower 237*a* is guided by the left outer face cam 294*o* or the left inner face cam 294*i*, the mover 142 is moved toward the sorting position sp at a constant speed faster than the moving speed in the upper connecting inner face cam 295*i* or the upper connecting outer face cam 295*o*.

Next, since the first cam follower 236*a* or the second cam follower 237*a* is guided by the lower connecting inner face cam 297*i* or the lower connecting outer face cam 297*o*, the mover 142 is moved toward the sorting position sp while it is continuously decelerated from the moving speed of the left outer face cam 294*o* or the left inner face cam 294*i*.

Since the first cam follower 236*a* is guided at the first radius r1 closest to the rotating axis 166 by the lower inner face cam 288*i*, the mover 142 is rotated in a counterclockwise direction while it maintains the sorting position sp.

Subsequently, the first cam follower 236*a* or the second cam follower 237*a* is continuously accelerated by the lower connecting inner face cam 297*i* or the lower connecting outer face cam 297*o* to be moved from the sorting position sp toward the pushing-out position pp.

Further, since the first cam follower 236*a* or the second cam follower 237*a* is moved with a constant acceleration by the right outer face cam 296*o* or the right inner face cam 296*i*, the mover 142 is moved toward the pushing-out position pp at a high speed.

When further rotated, since the first cam follower 236*a* or the second cam follower 237*a* is guided by the upper connecting inner face cam 295*i* or the upper connecting outer face cam 295*o*, the mover 142*a* is moved toward the pushing-out position pp by the right outer face cant 296*o* or the right inner face cam 296*i* while being decelerated to a slow speed.

When further rotated, the first cam follower 236*a* or the second cam follower 237*a* is guided by the upper outer face cam 292, so that the mover 142 is moved in the counterclockwise direction while it maintains the pushing-out position pp.

Next, movement of the mover 142 performed by the plate-shaped cam 146 will be described based upon the ease where the mover 142 is positioned at the sorting position sp with reference to FIG. 13 to FIG. 15.

When the rotating disk 122 is rotated, coins c stored in the storing bowl 124 are stirred by steps due to the pushing disc 138 or the like, and after surfaces or back surfaces of the coins C advance from the upper face opening 191 to the sorting recess 132, they come in surface contact with the upper face 154 to be held in the sorting recesses 132*a*, 132*b*, and 132*c* one by one. In other words, coins having a diameter exceeding a diameter to be received cannot come in surface contact with the upper face 154 between an inner edge of the storing bowl 124, and each of the pushing edges 144*a*, 144*b*, and 144*c*, so the they are not held in the respective sorting recesses 132*a*, 132*b*, and 132*c*.

Similarly, smallest coins Sc to be received are not held in the respective sorting recesses 132*a*, 132*b*, and 132*c* two by two in parallel, and one of the two small-diameter (smallest-diameter) coins SC is partially stacked on the other in each of the sorting recesses 132*a*, 132*b*, and 132*c*, so that when each of the sorting recesses 132*a*, 132*b*, and 132*c* is moved upward, the coin SC partially stacked on the coin SC held in each of the sorting recesses 132*a*, 132*b*, and 132*c* cannot be supported by the pushing disc 138, thereby dropping due to its own weight. In other words, coins with a diameter to be sorted are sorted and held in the sorting recesses 132*a*, 132*b*, and 132*c* one by one.

Figure 13:
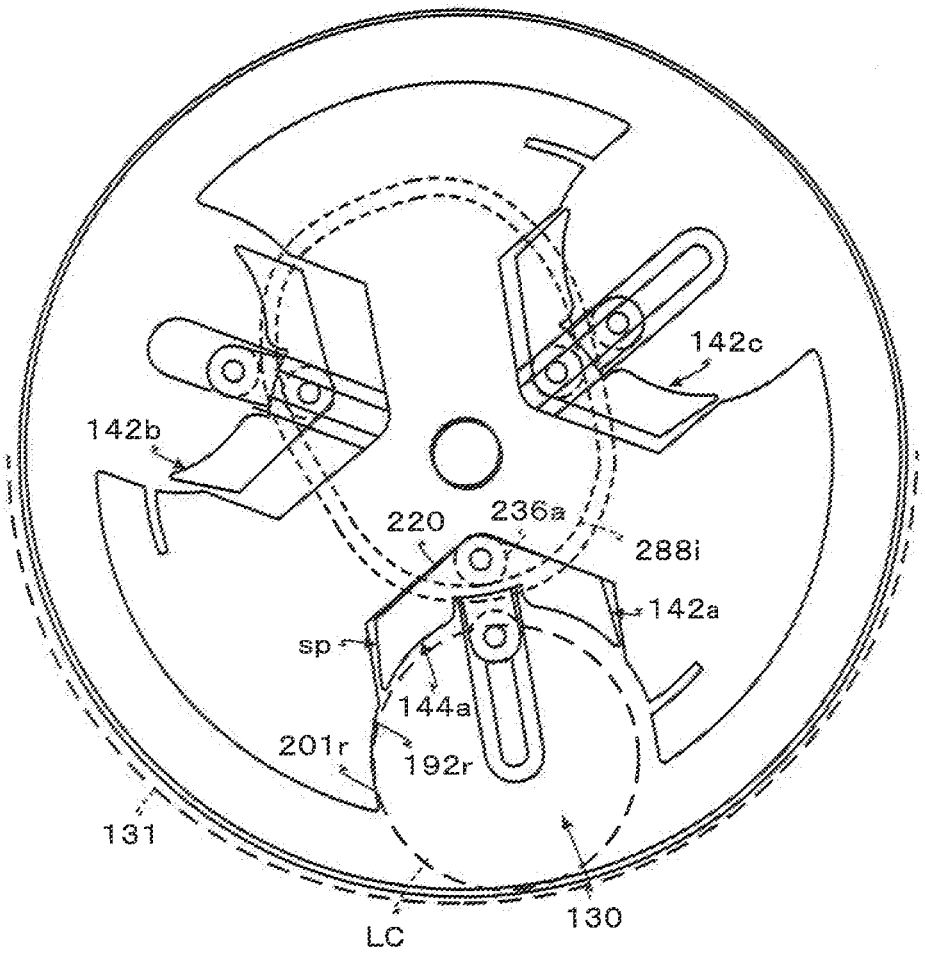
FIG. 13 is an operation-explaining view (sorting position) relating to the rotating disk of the coin-separating and feeding device according to the embodiment of the present invention.

As shown in FIG. 13, the mover 142*a* is configured such that, when it is positioned at the sorting position sp, the mover bottom edge 220 comes close to the bottom edge 184 in a state where the first cam follower 236*a* is in contact with the lower inner face cam 288*i* so that the mover 142*a* cannot be moved further upward (toward the rotating axis 166). In other words, the second cam follower 237*a* is prevented from being guided by the lower outer face cam 2880. In addition, since the mover 142*a* is guided by the lower inner face cam 288*i*, it cannot be guided downward beyond the position guided by the lower inner face cam 2880. That is, since the pushing edge 144*a* of the mover 142*a* does not come close to the inner face of the arc-shaped restrictor 131 beyond the position thereof, the mover 142*a* maintains the sorting position sp in the range of the first angle $\alpha$1.

When the rotating disk 122 is rotated in the counterclockwise direction while the mover 142*a* maintains the sorting position sp, a coin C held in the holding recess 130*a* is pushed and moved by the right curved portion 192*r* or the right distal end side wall 201*r* constituting a rear position side of the sorting recess 132*a* in the rotating direction and is rotated in the counterclockwise direction following the rotation of the rotating disk 122 while being guided by the arc-shaped restrictor 131 (storing bowl 124).

Figure 14:
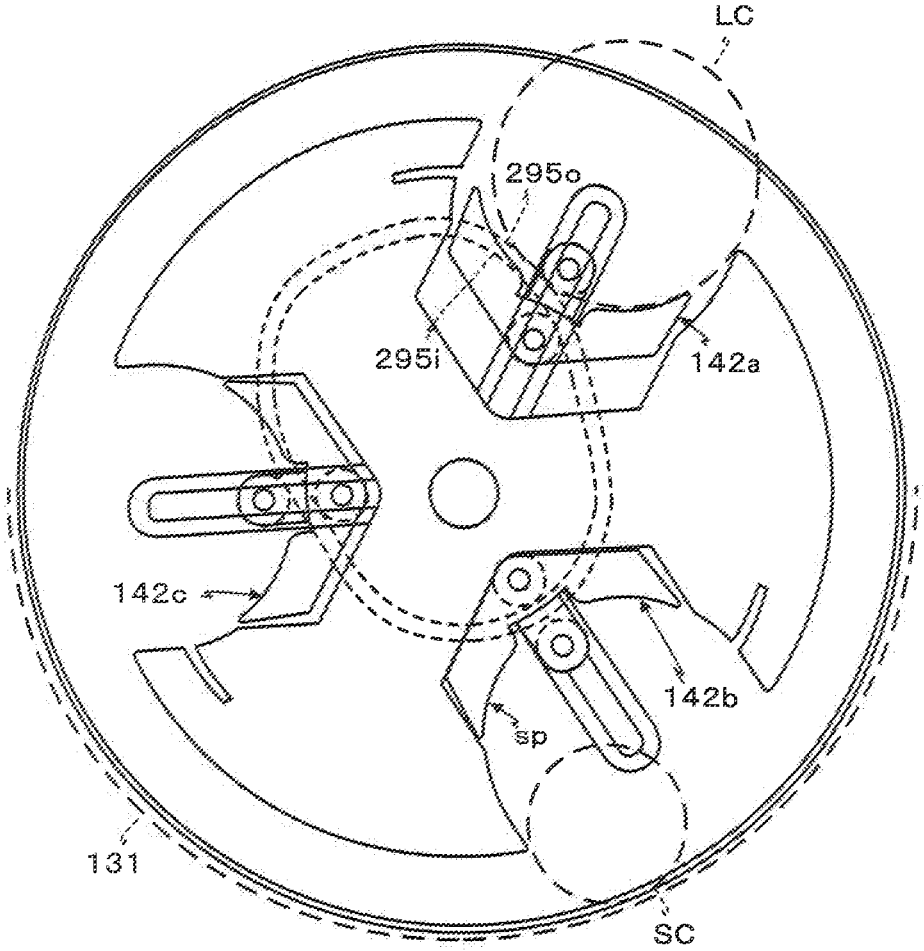
FIG. 14 is an operation-explaining view (in the course of movement) relating to the rotating disk of the coin-separating and feeding device according to the embodiment of the present invention.

When the rotating disk 122 is further rotated from the state shown in FIG. 13 in a counterclockwise direction, since the first cam follower 236*a* and the second cam follower 237*a* are guided by the lower connecting inner face cam 297*i* or the lower connecting outer face cam 297*o* of the plate-shaped cam 146 and further by the right inner face cam 296*i* or the right outer face cam 296*o* and they are then guided by the upper connecting outer face cam 295*o* or the upper connecting inner face cam 295*i*, the mover 142*a* is gradually moved toward the peripheral face opening 190 so that the coin C is also pushed and moved toward the peripheral direction of the rotating disk 122 by the pushing edge 144*a* (FIG. 14).

Even in this case, since the distance D1 between the first cam follower 236*a* and the second cam follower 237*a* is wider than the plate-shaped cam 146, the mover 142*a* is still moved smoothly while being guided by the right inner face cam 296*i* or the right outer face cam 296*o*.

Figure 15:
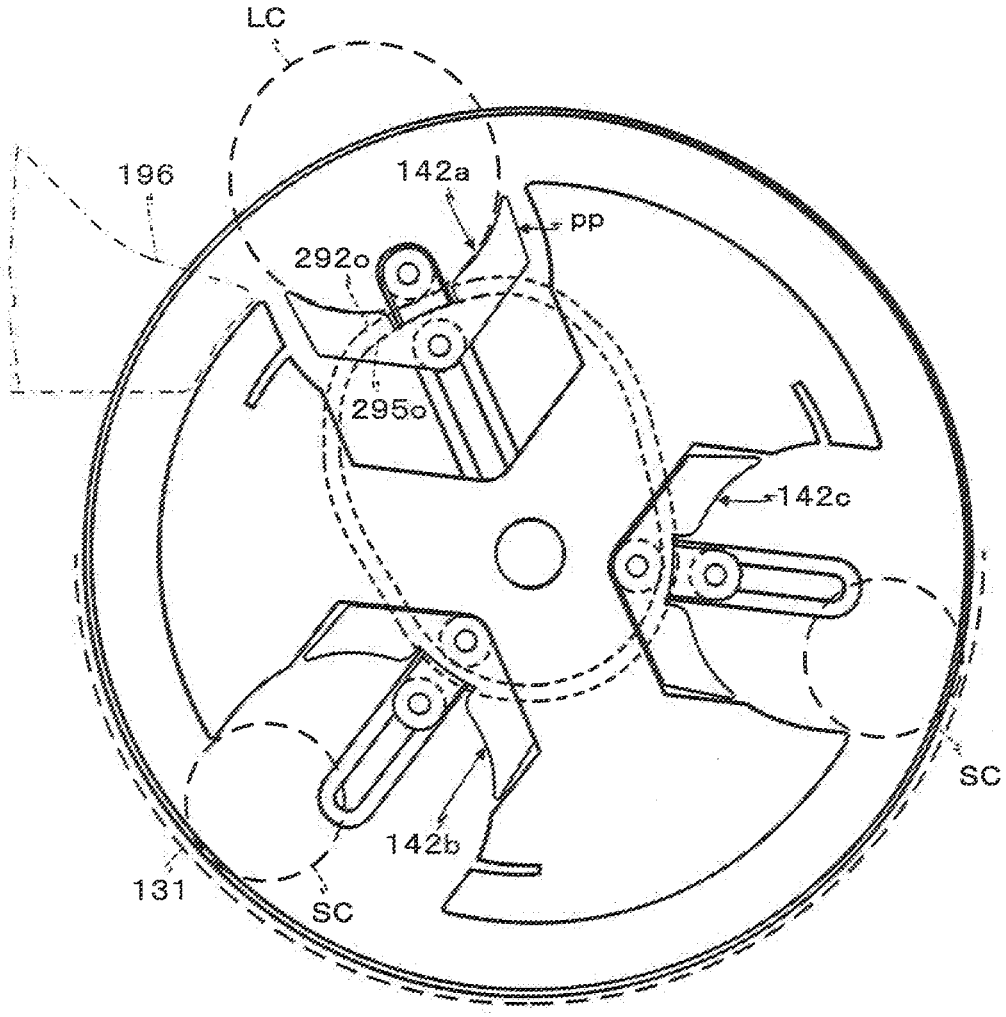
FIG. 15 is an operation-explaining view (pushing-out position) relating to the rotating disk of the coin-separating and feeding device according to the embodiment of the present invention.

When the rotating disk 122 is further rotated, the first cam follower 236*a* and the second cam follower 237*a* reach a phase guided by the upper outer face cam 292*o* of the plate-shaped cam 146, and the mover 142*a* is positioned at the pushing-out position pp (FIG. 15). At the pushing-out position pp, the second cam follower 237*a* comes in contact with the upper outer face cam 292*o* to be guided. In this case, a distal end of the passive support part 222*a* comes close to an end face of the upper groove 208*a* to be prevented from projecting further outward. In other words, the mover 142*a* maintains the pushing-out position pp whose position is defined by the upper outer face cam 292*o* in a range of the second angle $\alpha$2 to continuously position the coin C near the outer periphery of the rotating disk 122.

In addition, since the position of the mover 142*a* is held at the pushing-out position pp by the upper outer face earn 292*o*, the coin C which has been pushed out by the mover 142*a* takes a position suitable for delivery continuously.

When the rotating disk 122 is further rotated, after the first cam follower 236*a* and the second cam follower 237*a* are guided by the upper connecting inner face cam 295*i* or the upper connecting outer face cam 295*o* of the plate-shaped cam 146, they are guided by the left inner face cam 294*i* and the left outer face cam 294*o*, so that the mover 142*a* is gradually moved from the pushing-out position pp toward the sorting position sp. Even in this case, since the distance D1 between the first cam follower 236*a* and the second cam follower 237*a* is sufficiently wider than the plate-shaped cam 146, the mover 142*a* is smoothly moved while being guided by the left inner face cam 294*i* or the left outer face cam 294*o*.

Next, the operation of this embodiment will be described mainly with reference to FIG. 13 to FIG. 15.

When the rotating disc 122 is rotated from the state shown in FIG. 13 in the counterclockwise direction, as described above, the movers 142*a*, 142*b*, and 142*c* are positioned at the sorting position sp below the rotating axis 166, and coins can be held in the sorting recesses 132*a*, 132*b*, and 132*c* one by one, respectively.

In FIG. 13, while the mover 142*a* positioned at the lowermost position is guided according to rotation in the counterclockwise direction of the rotating disk 122, and the first cam follower 236*a* and the second cam follower 237*a* are guided by the lower connecting inner face earn 297*i* and the lower connecting outer face cam 297*o*, and the right outer face cam 296*o* and the right inner face cam 296*i*, the mover 142*a* is moved from the sorting position sp toward the pushing-out position pp. As shown in FIG. 14, a coin C held in the sorting recess 132*a* is also moved toward the outer periphery of the rotating disk 122 according to movement of the i cover 142*b*.

When the rotating disk 122 is further rotated in the counterclockwise direction, as shown in FIG. 15, the second cam follower 237*a* is guided by the upper outer face cam 292*o* and the mover 142*a* is held at the pushing-out position pp. Thereby, the coin C is moved linearly to be pushed out of the sorting recess 132*a* completely and is brought close to the knife 196. In particular, by setting the shape of the upper connecting outer face cam 295*o* or the upper connecting inner face cam 295*i* properly, the moving speed of the mover 142*a* is controlled so that connection of the coin C with the pushing edge 144*a* can be substantially maintained without the coin C being discharged by inertial force generated when the coin C has been moved to the pushing-out position pp.

While the coin C maintains the pushed-out position, it is pushed by the impeller 105 to be pushed against the knife 196, and the physical property of the coin C is then detected by a sensor (not shown) while the coin C is being moved along the guide 107. The coin discriminating device 106 performs truth/false discrimination and denomination discrimination of the coin C based upon the detected physical property.

When the rotating disk 122 is further rotated in the counterclockwise direction, the first cam follower 236*a* and the second cam follower 237*a* are guided by the upper connecting outer face cam 295*o* and the upper connecting inner face cam 295*i*, and the left inner face cam 294*i* and the left outer face cam 294*o* to be moved from the pushing-out position pp toward the sorting position sp.

DESCRIPTION OF SOME REFERENCE CHARACTERS

106 coin discriminating device
122 rotating disk
130 holding recess
131 arc-shaped restrictor
132 sorting recess
134 rotating flat circular plate
138 pushing disc
142 mover
144 pushing edge
146 plate-shaped cam
154 upper face
182 sorting recess groove
184 bottom edge
191 upper opening
190 peripheral opening
200*l* left side wall
200*r* right side wall
225 driving device
236*a*, 268*a* cam follower
C coin
Sp sorting position
Pp pushing-out position Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin-separating apparatus and feeding device where, after coins are sorted individually by holding the coins in sorting recesses opened on an upper side and a peripheral edge side thereof on an upper face of a rotating disk arranged in an inclination state, the coins are fed out to a coin discriminating device, comprising:

each of the sorting recesses has a peripheral opening and an upper face opening formed by a sorting recess groove extending radially outward relative to a center of the rotating disk toward an outer peripheral edge thereof;

a mover member is disposed, so as to reciprocate linearly between a sorting position on a bottom portion of the sorting recess groove and a pushing-out position on the peripheral edge side of the rotating disk, within the sorting recess groove, the mover member has a pushing edge facing the peripheral opening, and forms a holding recess surrounded by a left side wall and a right side wall of the sorting recess, and an arc-shaped restrictor surrounding an outer periphery of the rotating disk; and a driving device comprises a ring-like plate-shaped cam fixedly arranged on the rotating disk, and a pair of cam followers positioned inside and outside the plate-shaped cam integrally with the mover member, wherein the holding recess is formed such that when the mover member is positioned at the sorting position, only one largest coin can be positioned in the holding recess but two smallest coins cannot be positioned therein in a parallel fashion, wherein, after the mover member is moved linearly toward the pushing-out position on the peripheral edge side in a predetermined phase of the rotating disk and subsequently after the mover member stays at the pushing-out position for a predetermined period of time, the mover member is driven by the driving device for moving the mover member to the sorting position linearly.

2. The coin-separating apparatus and feeding device according to claim 1, wherein the mover member includes a pushing part having the pushing edge facing the peripheral opening and a guided portion extending from an intermediate portion of the pushing part toward the rotating disk and then further extending toward the peripheral opening, and the guided portion is slidably disposed within a linear guide hole formed on an upper face of the rotating disk from a rotating axis of the rotating disk radially.

3. The coin-separating apparatus and feeding device according to claim 1, wherein the mover member is formed in such a V shape that a mover member bottom edge positioned on the opposite side of the pushing edge gradually comes close to the peripheral edge side from a central portion toward an end portion, and a bottom edge of the sorting recess groove is formed into a similar V shape to the mover member bottom edge.

4. The coin-separating apparatus and feeding device according to claim 1, wherein the mover member at the pushing-out position is guided by an outer face cam of the plate-shaped cam, while the mover member at the sorting position is guided by an inner face cam of the plate-shaped cam.

5. A coin-separating apparatus and feeding device where, after coins are sorted individually by holding the coins in sorting recesses disposed on an upper face of a rotating disk arranged in an inclination state and having an upper opening and a peripheral opening, the coins are fed to a coin discriminating device, comprising:

each of the sorting recess has a sorting recess groove extending linearly adjacent the center of the rotating disk toward an outer peripheral edge thereof, a mover member reciprocating linearly between a sorting position close to a bottom of the sorting recess groove and a pushing-out position on the periphery side of the sorting recess groove is disposed within the sorting recess groove, wherein the mover member has a pushing edge facing the peripheral opening and forms a holding recess surrounded by a left side wall and a right side wall of the sorting recess groove, and an inner peripheral face of an arc-shaped restrictor surrounding an outer periphery of the rotating disk, and the holding recess is formed such that when the mover member is positioned at the sorting position, only one largest coin can be positioned in the holding recess but two smallest coins cannot be positioned therein in a parallel fashion, wherein the pushing edge of the mover member is formed in a recessed shape in such a manner that, when the mover member is positioned at the sorting position, the pushing edge is formed in a semi-circular shape slightly larger than the diameter of the largest coin in cooperation with the left side wall and the right side wall such that only one largest coin can be positioned in the semi-circular shape but two smallest coins cannot be positioned therein in a parallel fashion; and a driving device comprises a ring-like plate-shaped cam fixedly arranged on the rotating disk, and a pair of cam followers positioned inside and outside the plate-shaped cam integrally with the mover member, wherein after the mover member is moved linearly toward the pushing-out position on the peripheral edge side in a predetermined phase of the rotating disk and subsequently after the mover member stays at the pushing-out position for a predetermined period of time, the mover member is driven by a driving device for moving the mover member to the sorting position linearly.

6. A coin-separating apparatus and feeding device where, after coins are sorted individually by holding the coins in sorting recesses having an upper opening and a peripheral opening on a peripheral side and disposed on an upper face of a rotating disk arranged in an inclination state, the coins are fed to a coin discriminating device, comprising:

each of the sorting recesses has a sorting recess groove extending linearly from adjacent the center of the rotating disk toward an outer peripheral edge thereof, a mover member reciprocating linearly between a sorting position close to a bottom of the sorting recess groove and a pushing-out position on a peripheral edge side of the sorting recess groove is disposed within the sorting recess groove, the mover member has a pushing edge facing the peripheral opening and forms a holding recess surrounded by a left side wall and a right side wall of the sorting recess, and an arc-shaped restrictor surrounding an outer periphery of the rotating disk, and the holding recess is formed such that when the mover member is positioned at the sorting position, only one largest coin can be positioned in the holding recess but two smallest coins cannot be positioned therein in a parallel fashion, wherein, in the rotating disk, the upper opening and the peripheral opening opened on the peripheral side are formed and the sorting recess groove formed in a groove shape and extending linearly from the center of the rotating disk toward the outer peripheral edge thereof is constituted by a circular and thick plate-shaped rotating flat circular plate and a pushing disc disposed on an inclination upper face of the rotating flat circular plate coaxially with the rotating flat circular plate and formed with the sorting recess groove constituted by a left side wall and a right side wall extending from a central portion toward a peripheral direction approximately in parallel with each other, and a bottom edge connecting the left side wall and the right side wall to each other;

when the mover member is positioned at the sorting position, a holding recess at which one largest coin to be received can be held but two smallest coins cannot be held in a parallel fashion is formed by the pushing edge of the mover member, the left side wall and the right side wall, and the arc-shaped restrictor; and a driving device comprises a ring-like plate-shaped cam fixedly arranged on the rotating disk, and a pair of cam followers positioned inside and outside the plate-shaped cam integrally with the mover member.

7. A coin-separating apparatus and feeding device having a rotating disk arranged in an inclined position with sorting recesses for receiving coins of different sizes, comprising:

a sorting recess is formed on the rotating disk with an opening on a peripheral edge of the rotating disk and an opening on an upper surface of the rotating disk, the sorting recess is configured to hold the largest size coin of the coins of different sizes while also holding only one of the smallest size coins of the coins of different sizes within the sorting recess;

a mover member is mounted within the sorting recess to linearly reciprocate between a coin sorting position to receive a coin and a coin pushing-out position to eject the coin adjacent the peripheral edge of the rotating disk; and an arc-shaped restrictor is positioned adjacent a portion of the peripheral edge of the rotating disk to maintain a sorted coin within the recess as the rotating disk moves through a lower inclined movement to enable coin sorting in the coin sorting position, wherein the mover member is reciprocatively mounted in an elongated radial guide hole, positioned within the sorting recess on the rotating disk, with a coin pushing part positioned along the elongated radial hole in the sorting recess, a passive part slides along the elongated radial guide hole and a first support part extends through the elongated radial guide hole to support a first cam follower below the elongated radial guide hole, and wherein the mover member includes a second supporting part extending through the elongated radial guide hole to support a second cam follower.

8. The coin-separating apparatus and feeding device of claim 7 further including a cam member that is position between the first cam follower and the second cam follower and is configured to selectively contact the respective first cam follower and the second cam follower to move the mover member between a coin supporting position and a coin pushing out position.

9. The coin-separating apparatus and feeding device of claim 8 wherein the cam member is configured to provide a single cam member between the respective first cam follower and the second cam follower and is provided with an inner cam face and an outer cam face, wherein the cam member remains stationary and is configured to drive the mover member at different speeds between the coin separating position and the coin pushing out position when the rotating disk is rotated.

10. The coin-separating apparatus and feeding device of claim 1 wherein a plurality of sorting receivers are formed on the rotating disk with a Y-shaped pushing plate with a plurality of projecting portions arranged at equal intervals with the sorting recess formed between the respective projecting portions, a height of the plurality of projecting portions is slightly thinner than the thinnest of coins to be sorted.

11. The coin-separating apparatus and feeding device of claim 1 wherein a plurality of sorting recesses are formed on the rotating disk by a metal pushing plate with a plurality of projecting portions arranged at equal intervals with the sorting recesses formed between the respective projecting portions and a portion of the projecting portions adjacent an outer peripheral edge is elevated above the surface of the rotating disk to contact any coin riding on the projecting portions and release the coin riding to slide down the incline rotating disk.

12. The coin-separating apparatus and feeding device of claim 11 wherein the rotating disk is made of a resin.

13. The coin-separating apparatus and feeding device of claim 1 wherein a coin storing bowl mounts the rotating disk and provides for coin storage of coins to be sorted.

14. The coin-separating apparatus of claim 11 wherein the coin storing bowl is formed of resin and the arc-shaped restrictor is connected to the coin storing bowl and formed of metal.

* * * * *